US005677094A

United States Patent [19]

Umeda et al.

[11] Patent Number: 5,677,094

[45] Date of Patent: Oct. 14, 1997

[54] ELECTROPHOTOGRAPHIC PHOTOCONDUCTOR

[75] Inventors: Minoru Umeda; Tatsuya Niimi, both of Numazu, Japan

[73] Assignee: Ricoh Company, Ltd., Tokyo, Japan

[21] Appl. No.: 535,573

[22] Filed: Sep. 28, 1995

[30] Foreign Application Priority Data

| | | | |
|---|---|---|---|
| Sep. 29, 1994 | [JP] | Japan | 6-259368 |
| Sep. 29, 1994 | [JP] | Japan | 6-259369 |
| Sep. 29, 1994 | [JP] | Japan | 6-259370 |
| Sep. 29, 1994 | [JP] | Japan | 6-259371 |
| Sep. 29, 1994 | [JP] | Japan | 6-259372 |
| Sep. 29, 1994 | [JP] | Japan | 6-259373 |
| Sep. 29, 1994 | [JP] | Japan | 6-259374 |

[51] Int. Cl.[6] ..... G03G 5/047

[52] U.S. Cl. ..... 430/58; 430/59

[58] Field of Search ..... 430/58, 59

[56] References Cited

U.S. PATENT DOCUMENTS

| | | | |
|---|---|---|---|
| 4,727,009 | 2/1988 | Takai | 430/58 |
| 4,772,525 | 9/1988 | Badesha et al. | 430/58 |
| 4,933,244 | 6/1990 | Teuscher | 430/58 |
| 5,028,687 | 7/1991 | Yanus et al. | 528/203 |
| 5,310,613 | 5/1994 | Pai et al. | 430/59 |
| 5,316,880 | 5/1994 | Pai et al. | 430/58 |
| 5,456,989 | 10/1995 | Nogami et al. | 430/59 |
| 5,547,790 | 8/1996 | Umeda et al. | 430/58 |

*Primary Examiner*—Roland Martin

*Attorney, Agent, or Firm*—Oblon, Spivak, McClelland, Maier & Neustadt, P.C.

[57] ABSTRACT

An electrophotographic photoconductor is disclosed which includes an electroconductive support, and a photoconductive layer formed thereon and having a charge generation layer and a charge transport layer, wherein the charge generation layer contains a polymeric charge transporting material having an ionization potential of 6.0 eV or less. The photoconductor may include an undercoat layer, an intermediate layer and/or a surface protecting layer, each of which may contain a polymeric charge transporting material. Specific use of the polymeric charge transporting material together with a charge transporting small molecule is also disclosed.

49 Claims, 1 Drawing Sheet

ELECTROPHOTOGRAPHIC PHOTOCONDUCTOR

BACKGROUND OF THE INVENTION

This invention relates to an electrophotographic photoconductor used in a copying machine, a laser printer or a laser facsimile apparatus, and more particularly to an electrophotographic photoconductor having an electroconductive support and a photoconductive layer provided thereon and including charge transporting and charge generating materials.

The Carlson process and other processes obtained by modifying the Carlson process are conventionally known as the electrophotographic methods and widely utilized in the copying machine and printer. In a photoconductor for use with the electrophotographic method, an organic photoconductive material is now widely used because such a photoconductor can be manufactured at low cost by mass production and causes no environmental pollution.

Many kinds of organic photoconductors have been conventionally proposed, for example, a photoconductor employing a photoconductive resin such as polyvinyl carbazole (PVK); a photoconductor comprising a charge transport complex of polyvinyl carbazole (PVK) and 2,4,7-trinitrofluorenone (TNF); a photoconductor of pigment dispersed type in which a phthalocyanine pigment is dispersed in a binder resin; and a function-separating photoconductor comprising a charge generating material and a charge transporting material. In particular, the function separating photoconductor has now attracted considerable attention.

When function separating photoconductor is charged to a predetermined polarity and exposed to light, the light pass through a transparent charge transport layer, and is absorbed by a charge generating material in a charge generation layer. The charge generating generates charge carriers by the absorption of light. The charge carriers generated in the charge generation layer are injected into the charge transport layer, and move in the charge transport layer depending on the electrical field generated by the charging process. Thus, latent electrostatic images are formed on the surface of the photoconductor by neutralizing the charge thereon. As is known, it is effective that the function separating electrophotographic photoconductor employ in combination a charge transporting material having an absorption intensity mainly in the ultraviolet region, and a charge generating material having an absorption intensity in a range from the visible region extending to the near infrared region.

Many low-molecular compounds have been developed to obtain the charge transporting materials. However, it is necessary that the low-molecular weight charge transporting material be dispersed and mixed with an inert polymer to prepare a coating liquid for a charge transport layer because the film-forming properties-of such a low-molecular weight compound is very poor. The charge transport layer thus prepared by using the low-molecular weight compound and the inert polymer is generally so soft, that peeling of the charge transport layer easily occurs during the repeated electrophotographic operations by the Carlson process.

In addition, the charge mobility has its limit in the above-mentioned charge transport layer employing low-molecular weight charge transporting material. The Carlson process cannot be carried out at a high speed, and the size of apparatus cannot be decreased due to the poor charge mobility in the charge transport layer when the amount of the low-molecular weight charge transporting material is 50 wt. % or less to the total weight of the charge transport layer. Although the charge mobility can be improved by increasing the amount of the charge transporting material, the film-forming properties deteriorate.

To solve the problems of the low-molecular weight charge transporting material, considerable attention has been paid to high-molecular weight charge transporting material. For example, a variety of high-molecular weight charge transporting materials are proposed as disclosed in Japanese Laid-Open Patent Applications Nos. 50-82056, 51-73888, 54-8527, 54-11737, 56-150749, 57-78402, 63-285552, 1-1728, 1-19049 and 3-50555.

However, photosensitivity of the function-separating laminated photoconductor in which a charge transport layer comprises a high-molecular weight charge transporting material is extraordinarily inferior to that of the above-mentioned laminated photoconductor employing a low-molecular weight charge transporting material in the charge transport layer.

To improve the photosensitivity of a laminated electrophotographic photoconductor in which a high-molecular weight charge transporting material is employed in the charge transport layer, it is proposed to add a low-molecular weight charge transporting material to the charge generation layer or the charge transport layer, as disclosed in Japanese Laid-Open Patent Application 5-34938. However, when the low-molecular weight charge transporting material is added to the high-molecular weight charge transporting material in the charge transport layer, the peeling of the charge transport layer easily occurs during the repeated operations. On the other hand, when the low-molecular weight charge transporting material is contained in the charge generation layer, the photosensitivity slightly increases, but does not attain to a satisfactory level.

As previously explained, when the charge transport layer of the function separating laminated photoconductor comprises the low-molecular weight charge transporting material and the inert polymer, the charge mobility, that is, the response speed has the limitation, and the charge transport layer easily tends to peel during the repeated operations.

The laminated photoconductor in which the high-molecular weight charge transporting material is employed in the charge transport layer can solve the above-mentioned problems, but causes a fatal problem of low photosensitivity. All the characteristics cannot be satisfied as mentioned above even thought the high-molecular weight charge transporting material is used in combination with the low-molecular weight charge transporting material.

SUMMARY OF THE INVENTION

The inventors of the present invention have conducted a study on the generation of photocarriers in the laminated photoconductor in which a bisazo pigment and a trisazo pigment are contained in a charge generation layer. As a result, it has been found that exciton generated in the charge generation layer after absorption of light causes disassociation at the interface between the charge generation layer and the transport layer, thereby generating photo-carrier (Japanese Applied Physics Vol. 29, No. 12, pp. 2746–2750, and Japanese Journal of Applied Physics Vol. 72, No. 1, pp. 117–123).

After further intensive study, the following facts have been found:

(1) All the organic charge generating materials can contribute to the generation of photocarriers at the interface between the charge generation layer and the charge transport layer.

(2) In the case where a low-molecular weight charge transporting material is employed, a large quantity of photocarriers are generated when a charge generating material is well mixed with the low-molecular weight charge transporting material and brought into intimate contact therewith.

(3) The photocarriers can also be generated by the contact of a charge generating material and a high-molecular weight charge transporting material. A large quantity of photocarriers are generated when the charge generating material is well mixed with the high-molecular weight charge transporting material and brought into intimate contact therewith.

(4) The low-molecular weight charge transporting material contained in the charge transport layer permeates or diffuses into the charge generation layer when the charge transport layer is formed by the conventional casting method. As a result, the low-molecular weight charge transporting material can be sufficiently brought into contact with the charge generating material. In contrast, the high-molecular weight charge transporting material cannot permeate into the charge generation layer, so that the contact thereof with the charge generating material becomes insufficient. Consequently, photocarriers are not generated in a large amount so that the photosensitivity is not high.

On the basis of the above studies, it has now been found that a photoconductor having a photoconductive layer formed on an electroconductive support shows improved characteristics, such as photosensitivity, abrasion resistance, delamination resistance and ability to reproduce clear images, by using a polymeric charge transporting material in a specific manner.

Thus, in accordance with one aspect of the present invention there is provided an electrophotographic photoconductor including an electroconductive support, and a photoconductive layer formed on the electroconductive support and including a charge generation layer and a charge transport layer, wherein the charge generation layer comprises a first polymeric charge transporting material having an ionization potential of 6.0 eV or less.

In another aspect, the present invention provides an electrophotographic photoconductor including an electroconductive support, and a photoconductive layer formed on the electroconductive support and including a charge generation layer and a charge transport layer, wherein the charge generation layer comprises a first polymeric charge transporting material and the charge transport layer comprises a second polymeric charge transporting material and wherein at least one of the charge generation layer and charge transport layer additionally includes a charge transporting small molecule.

The present invention also provides an electrophotographic photoconductor including an electroconductive support, and a photoconductive layer formed on the electroconductive support and including a charge generation layer, a charge transport layer and an intermediate layer provided therebetween and containing a charge transporting small molecule, wherein the charge generation layer comprises a first polymeric charge transporting material and the charge transport layer comprises a second polymeric charge transporting material.

The present invention further provides an electrophotographic photoconductor including an electroconductive support, and a photoconductive layer formed on the electroconductive support and including a charge generation layer and a charge transport layer, wherein the charge generation layer comprises a polymeric charge transporting material and the charge transport layer comprises a charge transporting small molecule and a binder.

The present invention further provides an electrophotographic photoconductor including an electroconductive support, and a photoconductive layer formed on the electroconductive support and including a charge generation layer and a charge transport layer, wherein the charge transport layer comprises a polymeric charge transporting material and wherein an intermediate layer containing a charge transporting small molecule is interposed between the charge generation layer and the charge transport layer.

The present invention further provides an electrophotographic photoconductor including an electroconductive support, a photoconductive layer formed on the electroconductive support, and an undercoat layer provided between the photoconductive layer and the electroconductive support and containing a charge transporting small molecule and a polymeric charge transporting material.

The present invention further provides an electrophotographic photoconductor including an electroconductive support, a photoconductive layer formed on the electroconductive support, and a protecting layer provided over the surface of the photoconductive layer and including a polymeric charge transporting material.

The present invention further provides an electrophotographic photoconductor including an electroconductive support, and a photoconductive layer formed on the electroconductive support and including a charge generation layer and a charge transport layer, wherein the charge transport layer includes a polymeric charge transporting material and a charge transporting small molecule and wherein the concentration of the charge transporting small molecule in the charge transport layer decreases in the direction from the electroconductive support toward the surface of the photoconductive layer.

The present invention further provides a method of forming a charge generation layer including a charge generating material and a polymeric charge transport material on a surface, wherein a first liquid containing the charge generating material and a second liquid containing the polymeric charge transport material are simultaneously sprayed over the surface through separate spray nozzles, respectively.

It is an object of the present invention to provide an electrophotographic photoconductor with high photosensitivity.

Another object of the present invention is to provide an electrophotographic photoconductor capable of attaining a quick photoresponse performance.

It is a further object of the present invention to provide an electrophotographic photoconductor showing excellent abrasion resistance during the repeated operations.

It is yet a further object of the present invention to provide an electrophotographic photoconductor showing excellent adhesion between the conductive support and the photosensitive layer thereof.

It is a further object of the present invention to provide an electrophotographic photoconductor which shows only a low residual potential and a low dark decay even after repeated long time operations.

BRIEF DESCRIPTION OF THE DRAWINGS

Other objects, features and advantages of the present invention will become apparent from the detailed description of the preferred embodiments of the invention which follows, when considered in light of the accompanying drawings, in which.

DETAILED DESCRIPTION OF THE PREFERRED EMBODIMENTS OF THE INVENTION

Figure 1:
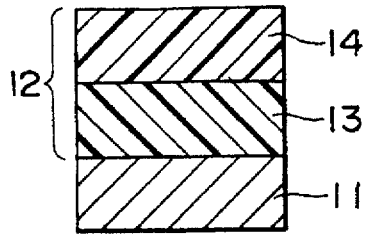
FIG. 1 is a schematic cross-sectional view showing one embodiment of an electrophotographic photoconductor according to the present invention.

Referring to FIG. 1, the electrophotographic photoconductor of the present invention has a conductive support 11 and a photoconductive layer 12 provided thereon. The photoconductive layer 12 in this embodiment is composed of a lower, charge generation layer 13 and an upper, charge transport layer 14.

Figure 2:
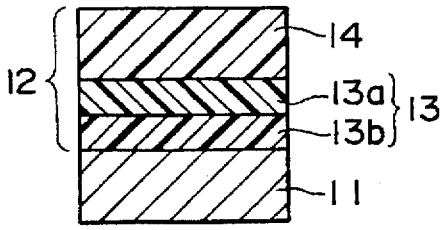
FIGS. 2 through 7 are schematic cross-sectional views, similar to FIG. 1, showing further embodiments of electrophotographic photoconductors according to the present invention.
Figure 3:
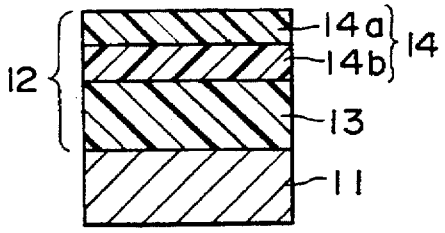
Figure 4:
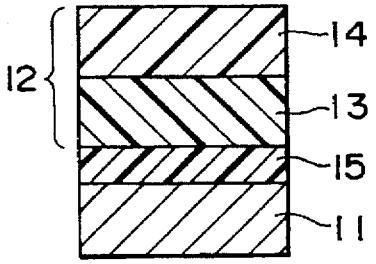
Figure 5:
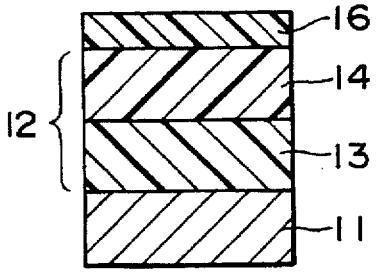
Figure 6:
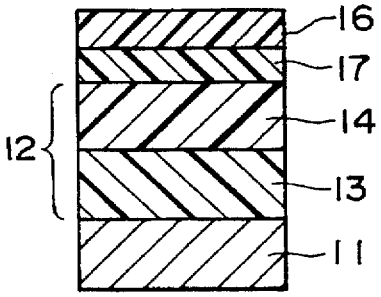
Figure 7:
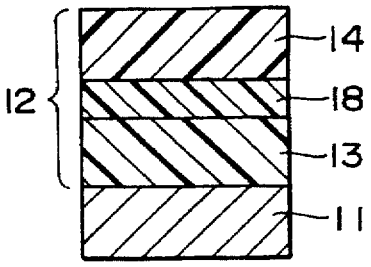

As shown in FIG. 2, the charge generation layer 13 may be divided into two or more layers 13*a* and 13*b* having different compositions. Likewise, the charge transport layer 14 may be constructed from two or more layers 14*a* and 14*b* having different compositions, as shown in FIG. 3. The photoconductor may be provided with one or more additional layers such as an undercoat layer 15 (FIG. 4), a protecting layer 16 (FIG. 5), an intermediate layer 17 (FIG. 6) and an intermediate layer 18 (FIG. 7). In the foregoing embodiments, the charge generating layer 13 may be positioned above the charge transport layer, if desired. Further, the photoconductive layer 12 may be constructed into a single layer structure.

The electroconductive support 11 of the photoconductor according to the present invention may be formed of an electroconductive material having a volume resistivity of $10^{10}$ Ω cm or less. The electroconductive support 11 can be prepared by coating a plastic film or a sheet of paper, which may be in a cylindrical form, with a metal such as aluminum, nickel, chromium, nichrome, copper, silver, gold or platinum or with a metal oxide such as tin oxide or indium oxide by vacuum deposition or sputtering. Alternatively, a sheet of aluminum, an aluminum alloy, nickel or stainless steel may be formed in a tube by the drawing and ironing (D.I.) method, the impact ironing (I.I.) method, the extrusion method or the protrusion method, followed by a surface treatment such as machining or abrasion.

The charge generation layer 13 contains as the main component a charge generating material. Any charge generating material conventionally used in electrophotographic photoconductors may be suitably employed for the purpose of the present invention.

Specific examples of the charge generating material include organic materials such as monoazo pigment, diazo pigment, trisazo pigment, perylene pigment, perinone pigment, quinacridone pigment, quinone condensation polycyclic compound, squaraines, phthalocyanine pigment, naphtahlocyanine pigment, and azulenium salt dye; and inorganic materials such as selenium, selenium-tellurium, selenium-arsenic compound, and amorphous silicon. The use of organic charge generating materials gives good results and is, thus, preferred. Illustrative of suitable azo pigments are those having a carbazole skeleton, a triphenylamine skeleton, a diphenylamine skeleton, a dibenzothiophene skeleton, a fluorenone skeleton, an oxadiazole skeleton, a bisstilbene skeleton, a distyryloxadiazole skeleton or a distyrylcarbazole skeleton. The above-mentioned charge generating materials can be used singly or in combination with two or more in the charge generation layer 13.

The charge generation layer 13 may further contain an electrically inert binder resin, if necessary. Examples of such a binder resin include polyamide, polyurethane, polyester, epoxy resin, polyketone, polycarbonate, silicone resin, acrylic resin, polyvinyl butyral, polyvinyl formal, polyvinyl ketone, polystyrene and polyacrylamide. These polymers may be used singly or in combination with two or more.

The charge generation layer 13 may be formed by applying a coating liquid containing the charge generating material and other ingredients by any suitable coating method such as a dip coating method, a spray coating method or a beads coating method. The coating liquid may be prepared by dispersing the ingredients in a suitable solvent such as tetrahydrofuran, cyclohexanone, dioxane, 2-butanone or dichloroethane using a ball mill, a sand mill or an attritor. The charge generation layer 13 generally has a thickness of 0.01–5 μm.

The charge transport layer 14 contains a charge transporting material which is a polymeric charge transporting material, a charge transporting small molecule or a mixture thereof.

Any known polymeric charge transporting material may be used for the purpose of the present invention. The weight average molecular weight (Mw) of the polymeric charge transporting material is preferably at least about 1,000, more preferably in the range of 2,000 to 2,000,000. Illustrative of suitable polymeric charge transporting materials are as follows:

(a) A polymeric material having a carbazole ring on the main chain and/or side chain thereof. For example, poly-N-vinylcarbazole, and compounds as disclosed in Japanese Laid-Open Patent Applications Nos. 50-82056, 54-9632, 54-11737 and 4-183719 can be employed.

(b) A polymeric material having a hydrazone structure on the main chain and/or side chain thereof. For example, compounds as disclosed in Japanese Laid-Open Patent Applications Nos. 57-78402 and 3-50555 can be employed.

(c) Polysilylene. For example, compounds as disclosed in Japanese Laid-Open Patent Applications Nos. 63-285552, 5-19497 and 5-70595 can be employed.

(d) A polymeric material having a tertiary amine structure on the main chain and/or side chain thereof. For example, N,N-bis(4-methylphenyl)-4-aminopolystyrene, and compounds as disclosed in Japanese Laid-Open Patent Applications Nos. 1-13061, 1-19049, 1-1728, 1-105260, 2-167335, 5-66598 and 5-40350 can be employed.

(e) Other polymeric materials. For example, formaldehyde condensation polymer of nitropylene, and compound as disclosed in Japanese Laid-Open Patent Applications Nos. 51-73888 and 56-150749 can be employed.

The above-mentioned polymeric charge transporting material may be used as such or, if desired, in the form of a copolymer with a conventional monomer, a block copolymer, a graft copolymer, a star shaped polymer or a crosslinked polymer having an electron donor group as disclosed in Japanese Laid-Open Patent Application 3-109406.

The charge transporting small molecule generally has a molecular weight lower than 1000 and may be an electron transporting substance or a hole transporting substance.

The electron transporting substance may be an electron acceptor such as chloranil, bromanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2b]thiophene-4-one and 1,3,7-trinitrobenzothiophene-5,5-dioxide. These substances may be used singly or in combination.

The hole transporting substance may be an electron donor such as poly-N-vinylcarbazole or a derivative thereof, poly-γ-carbazolylethyl glutanate or a derivative thereof, a pyrene-formaldehyde condensation product or a derivative thereof, polyvinylpyrene, polyvinylphenanthrene, an oxazole compound, an oxadiazole compound, an imidazole compound, a triphenylamine compound, 9-(p-diethylaminostyrylanthracene), 1,1-bis(4-dibenzylaminophenyl)propane, styrylanthracene, styrylpyrazoline, a phenylhydrazone compound, an α-phenylstilbene compound, a thiazole compound, triazole compound, a phenazine compound, an acridine compound, a benzofuran compound, a benzimidazole compound or a thiophene compound. These substances may be used singly or in combination.

The charge transport layer 14 may further contain a binder resin, a plasticizer, and/or a leveling agent.

Examples of the binder resins include thermoplastic resins and thermosetting resins such as polystyrene, styrene acrylonitrile copolymers, styrene-butadiene copolymers, styrene-maleic anhydride copolymers, polyester, polyvinyl chloride, vinyl chloride-vinyl acetate copolymers, polyvinyl acetate, polyvinylidene chloride, polyarylate resins, phenoxy resins, polycarbonate, cellulose acetate resins, ethyl cellulose resins, polyvinyl butyral, polyvinyl formal, polyvinyl toluene, acrylic resins, silicone resins, epoxy resins, melamine resins, urethane resins, phenolic resins and alkyd resins.

The plasticizer may be, for example, dibutyl phthalate or dioctyl phthalate and is used in an amount of up to 30% by weight based on the polymeric material contained in the charge transport layer.

The leveling agent may be, for example, silicone oils such as dimethyl silicone oil and methylphenyl silicone oil, or polymers and oligomers having a perfluoroalkyl group on the side chain thereof and is used in an amount of up to 1% by weight based on the polymeric material contained in the charge transport layer.

The charge transport layer 14 may be formed by applying a coating liquid containing the charge transporting material and other ingredients dissolved or dispersed in a suitable solvent such as tetrahydrofuran, cyclohexanone, dioxane, toluene, methylene chloride, monochlorobenzene or dichloroethane by any suitable coating method such as a dip coating method, a spray coating method or a beads coating method. The thickness of the charge transport layer 14 is generally 5–100 μm.

A photoconductive layer 12 of a single layer structure may be obtained by applying a coating liquid containing the above-described charge transporting material, charge generating material and a binder dissolved or dispersed in a suitable solvent on a conductive support. A photoconductive layer composed of a hole transporting material and a eutectic complex obtained from a pyrilium dye and a polycarbonate of bisphenol A may also be used for the single photoconductive layer 12. The binder used for the formation of the charge generation layer or charge transport layer may be also used for the formation of the single layer photoconductive layer 12. The thickness of the single photoconductive layer 12 is generally 5–100 μm.

The undercoat layer 15 (FIG. 4) provided between the electroconductive support 11 and the photoconductive layer 12 may be a resin layer having high resistance to organic solvents. Examples of suitable resins for use in the undercoat layer 15 include water-soluble resins such as polyvinyl alcohol, casein and sodium polyacrylate, alcohol-soluble resins such as copolymerized nylon and methoxymethylated nylon; and cured resins with three dimensional network structure such as polyurethane, melamine resins, phenolic resin alkyd-melamine resins and epoxy resins.

In addition, finely-divided pigment particles of a metal oxide such as titanium oxide, silica, alumina, zirconium oxide, tin oxide or indium oxide may be contained in the undercoat layer 15 to prevent the appearance of moire and to reduce the residual potential. The undercoat layer 15 may further contain a coupling agent such as silane coupling agent, titanium coupling agent or chromium coupling agent. The undercoat layer can be provided on the electroconductive support 11 by applying a coating liquid using an appropriate solvent by any suitable coating method.

Furthermore, the undercoat layer 15 may be a layer of $Al_2O_3$ deposits formed on the electroconductive support 11 by the anodizing process, or a layer of an organic material such as poly-para-xylylene (parylene) or an inorganic material such as ITO, SiO, $SnO_2$, $TiO_2$, or $CeO_2$ formed by vacuum-deposition on the electroconductive support 11.

Thickness of the undercoat layer 15 is generally 0.1–10 μm.

The protective layer 16 (FIG. 5) provided on the photoconductive layer 12 may be a resin layer. Examples of such a resin include ABS resins, ACS resins, olefin-vinyl monomer copolymers, chlorinated polyether, allyl resins, phenolic resins, polyacetal, polyamide, polyamideimide, polyacrylate, polyallyl sulfone, polybutylene, polybutylene terephthalate, polycarbonate, polyether sulfone, polyethylene, polyethylene terephthalate, polyimide, acrylic resins, polymethylpentene, polypropylene, polyphenylene oxide, polysulfone, polystyrene, AS resins, butadiene-styrene copolymers, polyurethane, polyvinyl chloride, polyvinylidene chloride and epoxy resins. A hardenable resin selected from the foregoing resins may be suitably used in conjunction with a curing agent.

To improve the abrasion resistance, amorphous carbon, a fluorine-containing resin such as polytetrafluoroethylene or a silicone resin may be incorporated into the protective layer 16. In addition, an inorganic material such as copper powder, tin powder, aluminum powder, indium powder, zinc oxide, indium oxide, antimony oxide, bismuth oxide, tin oxide doped with antimony, indium oxide doped with tin, titanium oxide, tin oxide or potassium titanate may be dispersed in the protecting layer 16. These fillers preferably have an average particle size of 0.5 μm or less.

The protective layer 16 may be formed on the photoconductive layer 12 by any conventional coating method. The thickness of the protective layer 16 is preferably in the range of about 0.5 to 10 μm. If desired, a vacuum-deposited thin film of i-C or a-SiC may be used as the protective layer 16 in the present invention.

An antioxidant may be contained in the electrophotographic photoconductor of the present invention to improve the environmental resistance of the photoconductor, in particular, to prevent a decrease of photosensitivity and an increase of residual potential due to oxidation. The antioxidant may be contained in any layer as long as the layer comprises an organic material. Particularly, when the antioxidant is contained in the layer which contains the charge transporting material, good results can be obtained. Any conventional antioxidant may be suitably used in the present invention. Commercially available antioxidants for use in rubbers, plastics, and fats and oils may be employed for the purpose of the present invention. The antioxidant is generally used in an amount of 0.1–100 parts by weight, preferably 2–30 parts by weight, per 100 parts by weight of the charge transporting material.

In addition, an ultraviolet absorber may be contained in the photoconductive layer and/or the protective layer to protect the photoconductive layer.

The intermediate layer 17 interposed between the photoconductive layer 12 and the protective layer 16 may be a layer of a resin such as polyamide, an alcohol-soluble nylon resin, a water-soluble polyvinyl butyral resin, polyvinyl butyral or polyvinyl alcohol. The intermediate layer 17 may be formed by any suitable conventional coating method. The thickness of the intermediate layer 17 is generally in the range of about 0.05 to 2 μm.

The electrophotographic photoconductor of the present invention may have any of the foregoing constructions and is characterized by the use of a polymeric charge transporting material in the following specific manners. In the following description, the terms "charge transport layer", "polymeric charge transporting material", "charge transporting small molecule", "charge generation layer", "charge generating material" and "binder" are intended to refer to those defined hereinbefore.

In the first embodiment, the charge generation layer includes a polymeric charge transporting material having an ionization potential of 6.0 eV or less. By this expedient, photocarriers may be easily and smoothly produced.

In this embodiment, the charge transport layer may be formed of a charge transporting small molecule and a binder. It is preferred that the ionization potential of the polymeric charge transporting material of the charge generation layer is equal to or greater than that of the charge transporting small molecule of the charge transport layer for reasons of smooth generation and injection of carriers. It is also preferred that the weight ratio of the charge transporting small molecule to the binder is 8:10 or less. The charge transport layer may additionally contain a polymeric charge transporting material. By this expedient, the photoconductor shows both high sensitivity and excellent resistance to abrasion.

The charge generation layer may consist of a plurality of stacked sub-layers each containing the polymeric charge transporting material, a charge generating material and a binder, wherein the concentration of the polymeric charge transporting material in one sub-layer is higher than that of the adjacent sub-layer located remote from the electroconductive support. Alternatively, the charge generation layer is a single layer containing the polymeric charge transporting material, a charge generating material and a binder, wherein the concentration of the polymeric charge transporting material continuously increases in the direction from the electroconductive support to the surface of the photoconductive layer. The above structure is effective in improving the flexibility and adhesion of the charge generation layer since the concentration of the binder is high at a position adjacent to the conductive support. In this case, it is preferred that the concentration of polymeric charge transporting material at a portion adjacent to the surface of the charge transport layer is 50% by weight or more, more preferably 80% by weight or more, while the concentration of the polymeric charge transporting material at that portion of the charge transport layer nearest to the electroconductive support is 50% by weight or less, preferably 20% by weight or less, based on the total weight of the binder and the polymeric charge transporting material.

The charge generation layer in which the concentration of the polymeric charge transporting material changes stepwise may be formed by successively repeating the application and drying of coating liquids while increasing the content of the polymeric charge transporting material contained therein. The charge generation layer in which the concentration of the polymeric charge transporting material changes continuously may be formed by successively applying coating liquids before complete drying of the previously applied coating while increasing the content of the polymeric charge transporting material contained therein.

In the second embodiment, the charge generation layer contains a first polymeric charge transporting material and the charge transport layer contains a second polymeric charge transporting material, wherein at least one of the charge generation layer and charge transport layer additionally includes a charge transporting small molecule. The photoconductor of this embodiment exhibits excellent abrasion resistance and a high photoresponse speed. The concentration of the charge transporting small molecule in the charge generation layer is generally 0.03–10 parts by weight per part by weight of the charge generating material, while the concentration of the charge transporting small molecule in the charge transport layer is generally 0.1–60% by weight.

In the third embodiment, an intermediate containing a charge transporting small molecule is provided between the charge generation layer containing a first polymeric charge transporting material and the charge transport layer containing a second polymeric charge transporting material. This embodiment can attain the effects similar to the second embodiment.

In the fourth embodiment, the charge generation layer contains a polymeric charge transporting material and the charge transport layer contains a charge transporting small molecule and a binder. It is preferred that the weight ratio of the charge transporting small molecule to the binder is 8:10 or less. In this embodiment, too, both high sensitivity and high abrasion resistance can be attained.

In the first through fourth emodiments, it is preferred that the ionization potential (Ip) of the polymeric charge transporting material for use in the charge generation layer 13 and the ionization potential (Ip') of the charge generating material satisfy the relationship of (Ip)<(Ip')+0.2 eV for reasons of high photosensitivity of the photoconductor. In the first through fourth embodiments, the amount of the polymeric charge transporting material in the charge generation layer is generally 0.1–10 parts by weight, preferably 0.2–5 parts by weight per parts by weight of the charge generating material. The amount of the charge transporting small molecule in the charge transport layer is generally 0.1–60% by weight.

In the fifth embodiment, the charge transport layer contains a polymeric charge transporting material and an intermediate layer containing a charge transporting small molecule is interposed between the charge generation layer and the charge transport layer. In this embodiment, too, both high sensitivity and high abrasion resistance can be attained. The thickness of the intermediate layer is generally in the range of about 0.05 to 2 μm.

In the sixth embodiment, an undercoat layer containing a charge transporting small molecule and a polymeric charge transporting material is provided between the photoconductive layer and the electroconductive support. The charge transporting small molecule serves to improve the sensitivity while the polymeric charge transporting material serves to improve both sensitivity and adhesion.

In the seventh embodiment, a protecting layer containing a polymeric charge transporting material is provided over the surface of the photoconductive layer. The protecting layer can provide high density charge transporting sites so that not only the abrasion resistance but also the photoresponse speed can be improved.

In the eighth embodiment, the charge transport layer contains a polymeric charge transporting material and a charge transporting small molecule, wherein the concentration of the charge transporting small molecule decreases (either continuously or stepwise) in the direction from the electroconductive support toward the surface of the photoconductive layer. In this embodiment, too, both high sensitivity and high abrasion resistance can be attained.

For reasons of obtaining optimum high sensitivity and abrasion resistance, it is preferred that the concentration of the charge transporting small molecule at a portion adjacent to the surface of the charge transport layer is 10% by weight or less, more preferably about 0 (zero), while the concentration of the charge transporting small molecule at that portion of the charge transport layer nearest to the electroconductive support is 20% by weight or more, more preferably 40% by weight or more.

In the present invention, two or more of the foregoing embodiments may be suitably combined as desired.

When the charge generation layer contains a charge generating material and a polymeric charge transport material, the following method is particularly effective in the formation of such a charge generation layer. Thus, a first liquid containing the charge generating material and, if desired, a binder and a second liquid containing the polymeric charge transport material are first prepared. The two coating liquids are simultaneously sprayed over a surface to be coated, such as the electroconductive support, through separate spray nozzles, respectively. Since the two coating liquids are prevented from contacting with each other before the coating operation, there is no fear of the formation of aggregates or precipitates in each coating liquid. Therefore, the coating liquids may use different solvent systems best suited for respective ingredients. The above method is also suited for the formation of the charge generation layer in which the concentration of the polymeric charge transporting material is changed in the thickness direction thereof by, for example, changing the spray rate of the second coating liquid.

The following examples will further illustrate the present invention.

EXAMPLE 1

On an aluminum-deposited surface of a polyethylene terephthalate film were successively applied and dried a coating liquid (1) for a charge generation layer and a coating liquid (2) for a charge transport layer having the compositions shown below, thereby obtaining an electrophotographic photoconductor No. 1 having the charge generation layer with a thickness of 0.2 μm and the charge transport layer with a thickness of 20 μm.

Coating Liquid (1):

| | |
|---|---|
| Charge generating material of the following formula: 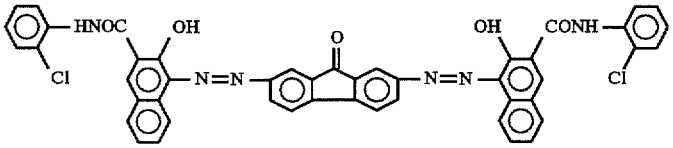 | 5 parts |
| Polymeric charge transporting material of the following formula (IP: 5.77 eV): 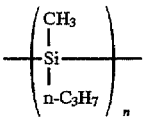 | 3 parts |
| Tetrahydrofuran | 400 parts |

Coating Liquid (2):

Polymeric charge transporting material of the following formula (IP: 5.7 eV): 10 parts

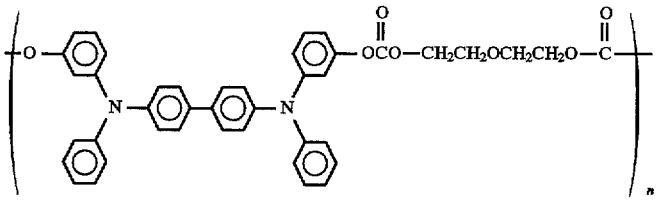

Methylene chloride 100 parts

Comparative Example 1

Example 1 was repeated in the same manner as described except that the coating liquid (1) was replaced by a coating liquid (3) having the composition shown below to obtain an electrophotographic photoconductor No. Comp. 1.

Coating Liquid (3):

Charge generating material of the following formula: 5 parts

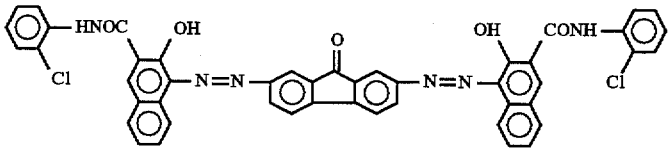

Polyvinyl butyral (ESLECK BL-1 manufactured by Sekisui Kagaku Kogyo K.K.) 3 parts Tetrahydrofuran 400 parts

Comparative Example 2

Example 1 was repeated in the same manner as described except that the coating liquid (1) was replaced by a coating liquid (4) having the composition shown below to obtain an electrophotographic photoconductor No. Comp. 2. composition:

Coating Liquid (4):

Charge generating material of the following formula: 5 parts

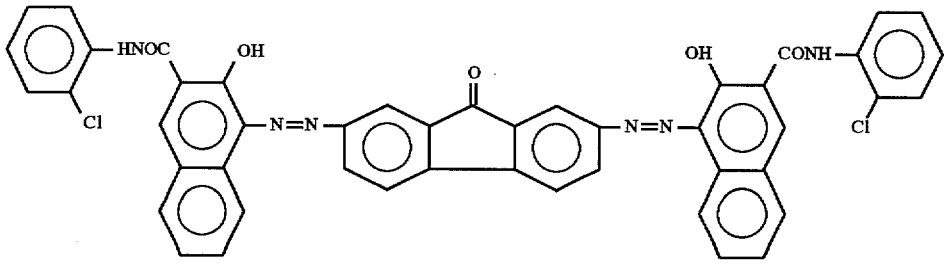

Polymeric charge transporting material of the following formula (IP: 6.1 eV): 3 parts

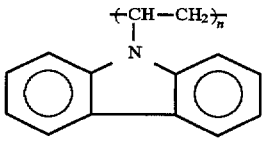

Tetrahydrofuran 400 parts

EXAMPLE 2

Over an outer surface of an aluminum cylindrical support having a diameter of 120 mm were successively applied and dried a coating liquid (5) for a charge generation layer and a coating liquid (6) for a charge transport layer having the compositions shown below, thereby obtaining an electrophotographic photoconductor No. 2 having the charge generation layer with a thickness of 0.3 μm and the charge transport layer with a thickness of 28 μm.

Coating Liquid (5):

| | |
|---|---|
| Charge generating material of the following formula: 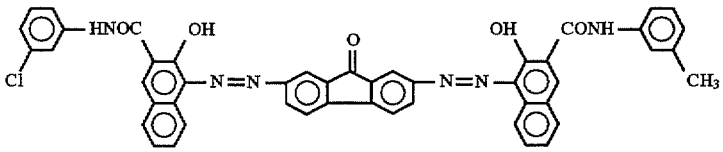 | 1 part |
| Polymeric charge transporting material of the following (IP: 5.62 eV): 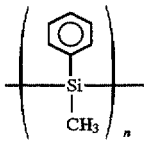 | 1 part |
| Tetrahydrofuran | 100 parts |
| Cyclohexanone | 50 parts |

Coating Liquid (6):

| | |
|---|---|
| Charge transporting material of the following formula (IP: 5.62 eV): 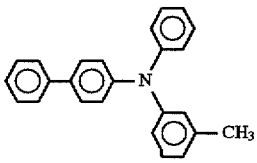 | 8 parts |
| Polycarbonate (LEXAN L-141 manufactured by General Electric Inc.) | 10 parts |
| Methylene chloride | 200 parts |

EXAMPLE 3

Example 2 was repeated in the same manner as described except that the coating liquid (2) was replaced by a coating liquid (7) having the composition shown below to obtain an electrophotographic photoconductor No. 3.

Coating Liquid (7):

| | |
|---|---|
| Charge transporting material of the following formula (IP: 5.39 eV): 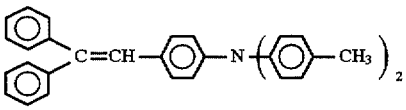 | 8 parts |
| Polycarbonate (LEXAN L-141 manufactured | 10 parts |

-continued

| | |
|---|---|
| by General Electric Inc.) | |
| Methylene chloride | 200 parts |

EXAMPLE 4

Example 2 was repeated in the same manner as described except that the coating liquid (2) was replaced by a coating liquid (8) having the composition shown below to obtain an electrophotographic photoconductor No. 4.

Coating Liquid (8):

| | |
|---|---|
| Charge transporting material of the following formula (IP: 5.78 eV): 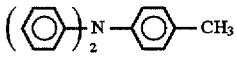 | 8 parts |
| Polycarbonate (LEXAN L-141 manufactured by General Electric Inc.) | 10 parts |
| Methylene chloride | 200 parts |

EXAMPLE 5

Over an outer surface of an aluminum cylindrical support having a diameter of 80 mm were successively applied two kinds of coating liquids (9) and (10) for a charge generation layer by spraying. The composition of each of the coating liquids (9) and (10) was shown below. After drying, a coating liquid (11) for a charge transport layer having the composition shown below, thereby obtaining an electrophotographic photoconductor No. 5 having the charge generation layer with a thickness of 0.5 μm and the charge transport layer with a thickness of 21 μm.

Coating Liquid (9):

| | |
|---|---|
| Charge generating material of the following formula: 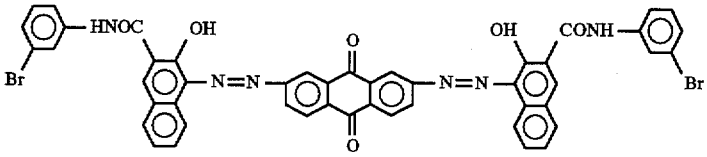 | 4 parts |
| Polyvinyl butyral (ESLECK BL-1 manufactured by Sekisui Kagaku Kogyo K.K.) | 2 parts |
| Tetrahydrofuran | 200 parts |
| Cyclohexanone | 50 parts |

Coating Liquid (10):

| | |
|---|---|
| Charge generating material of the following formula: 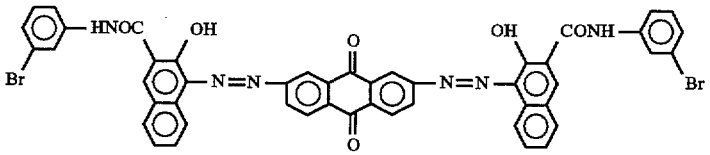 | 4 parts |
| Polymeric charge transporting material of the following formula (IP: 5.6 eV): 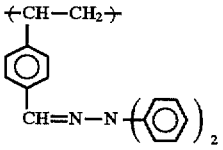 | 4 parts |
| Tetrahydrofuran | 200 parts |
| Cyclohexanone | 50 parts |

Coating Liquid (11):

| | |
|---|---|
| Charge transporting material of the following formula (IP: 5.55 eV): 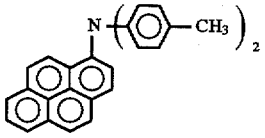 | 8 parts |
| Polycarbonate (PANLITE L-1225 manufactured by Teijin Kasei K.K.) | 10 parts |
| Tetrahydrofuran | 200 parts |

EXAMPLE 6

Example 5 was repeated in the same manner as described except that the coating liquid (9) was not used at all to obtain an electrophotographic photoconductor No. 6.

EXAMPLE 7

Over an outer surface of a support as used in Example 1 were successively applied two kinds of coating liquids (12) and (13) for a charge generation layer by spraying. The compositions of the coating liquids (12) and (13) are as shown below. After drying, a coating liquid (14) for a charge transport layer having the composition shown below, thereby obtaining an electrophotographic photoconductor No. 7 having the charge generation layer with a thickness of 0.6 μm and the charge transport layer with a thickness of 30 μm.

Coating Liquid (12):

Charge generating material of the following formula: 10 parts

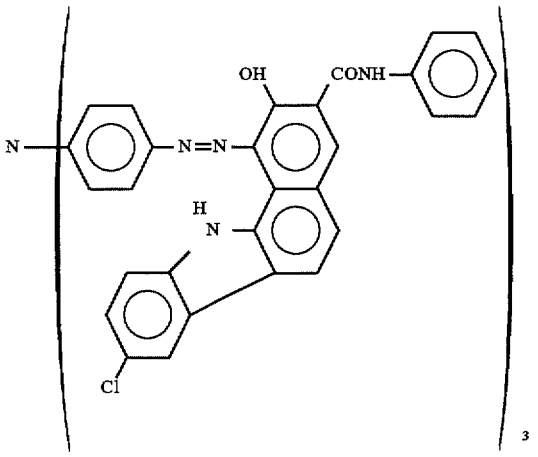

| | |
|---|---|
| Polyvinyl butyral (ESLECK BL-1 manufactured by Sekisui Kagaku Kogyo K.K.) | 2 parts |
| Tetrahydrofuran | 300 parts |

Coating Liquid (13):

Charge generating material of the following formula: 10 parts

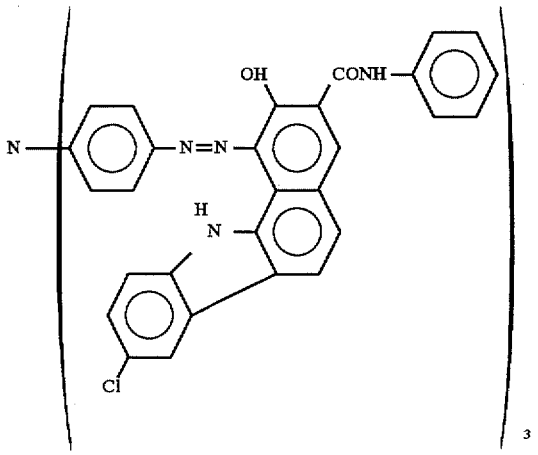

Polymeric charge transporting material of the following formula (IP: 5.7 eV): 4 parts

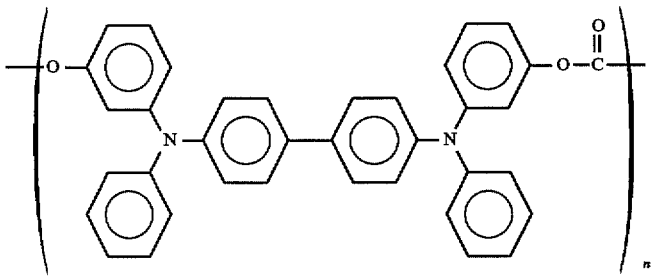

| | |
|---|---|
| Tetrahydrofuran | 300 parts |
| Cyclohexanone | 300 parts |

Coating Liquid (14):

| | |
|---|---|
| Charge transporting material of the following formula (IP: 5.6 eV): 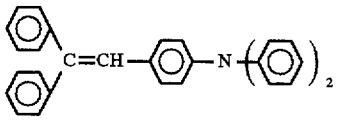 | 8 parts |
| Polycarbonate (A2500 manufactured by Idemitsu Petrochemical K.K.) | 10 parts |
| Tetrahydrofuran | 200 parts |

EXAMPLE 8

Example 7 was repeated in the same manner as described except that the coating liquid (12) was not used at all to obtain an electrophotographic photoconductor No. 8.

EXAMPLE 9

Example 2 was repeated in the same manner as described except that the coating liquid (6) for the formation of a charge transport layer was replaced by a coating liquid (15) having the composition shown below to obtain an electrophotographic photoconductor No. 9.

Coating Liquid (15):

| | |
|---|---|
| Polymeric charge transporting material of the following formula (IP: 5.62 eV): 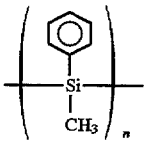 | 8 parts |
| Polycarbonate (PANLITE L-1225 manufactured by Teijin Kasei K.K.) | 10 parts |
| Methylene chloride | 200 parts |

EXAMPLE 10

Example 3 was repeated in the same manner as described except that the coating liquid (7) for the formation of a charge transport layer was replaced by a coating liquid (16) having the composition shown below to obtain an electrophotographic photoconductor No. 10.

Coating Liquid (16):

| | |
|---|---|
| Polymeric charge transporting material of the following formula (IP: 5.6 ev): 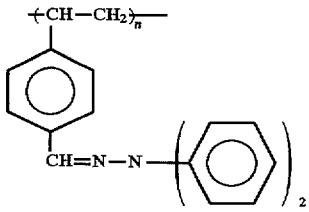 | 10 parts |
| Methylene chloride | 100 parts |

EXAMPLE 11

Example 5 was repeated in the same manner as described except that the coating liquid (11) for the formation of a charge transport layer was replaced by a coating liquid (17) having the composition shown below to obtain an electrophotographic photoconductor No. 11.

Coating Liquid (17):

| | |
|---|---|
| Polymeric charge transporting material of the following formula (IP: 5.6 eV): 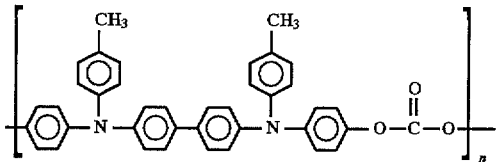 | 8 parts |
| Polycarbonate (A2500 manufactured by Idemitsu Petrochemical K. K.) | 10 parts |
| Methylene chloride | 200 parts |

EXAMPLE 12

Example 7 was repeated in the same manner as described except that the coating liquid (14) for the formation of a charge transport layer was replaced by a coating liquid (18) having the composition shown below to obtain an electrophotographic photoconductor No. 12.

Coating Liquid (18):

| | |
|---|---|
| Polymeric charge transporting material of the following formula (IP: 5.6 eV): 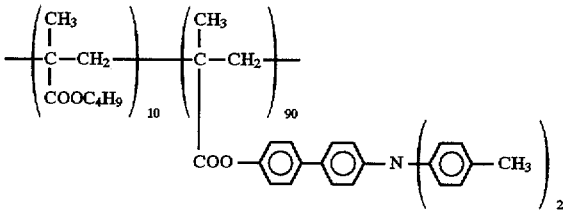 | 8 parts |
| Methylene chloride | 100 parts |

EXAMPLE 13

Example 2 was repeated in the same manner as described except that the coating liquid (6) for the formation of a charge transport layer was replaced by a coating liquid (19) having the composition obtain below to obtain an electrophotographic photoconductor No. 13.

Coating Liquid (19):

| | |
|---|---|
| Charge transporting material of the following formula (IP: 5.62 eV): 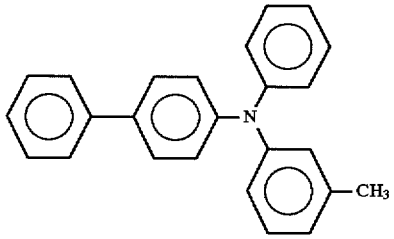 | 7 parts |
| Polycarbonate (LEXAN L-141 manufactured | 10 parts |

-continued

| | |
|---|---|
| by General Electric Inc.) | |
| Methylene chloride | 200 parts |

EXAMPLE 14

Example 2 was repeated in the same manner as described except that the coating liquid (6) for the formation of a charge transport layer was replaced by a coating liquid (20) having the composition shown below to obtain an electrophotographic photoconductor No. 14.

Coating Liquid (20):

| | |
|---|---|
| Charge transporting material of the following formula (IP: 5.62 eV): | 10 parts |

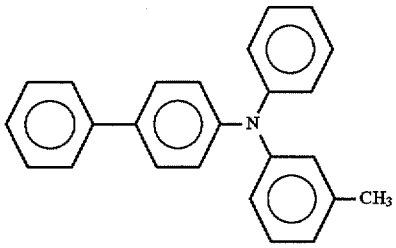

| | |
|---|---|
| Polycarbonate (LEXAN L-141 manufactured by General Electric Inc.) | 10 parts |
| Methylene chloride | 200 parts |

-continued

| | |
|---|---|
| Methanol | 70 parts |
| Butanol | 30 parts |

EXAMPLE 16

Example 7 was repeated in the same manner as described except that a coating liquid (22) having the composition shown below for the formation of an intermediate layer was applied before the formation of the charge transfer layer to obtain an electrophotographic photoconductor No. 16. The intermediate layer had a thickness of 0.3 μm.

Coating Liquid (21):

| | |
|---|---|
| Water-soluble polyvinyl acetal (ESLECK BL-1 manufactured by Sekisui Kagaku Kogyo K.K.) | 3 parts |
| Methanol | 50 parts |
| Water | 50 parts |

EXAMPLE 17

Example 1 was repeated in the same manner as described except that the charge generation layer was formed by simultaneously spraying coating liquids (23) and (24) having the compositions shown below through two spray nozzles at the same spraying rate, thereby to obtain an electrophotographic photoconductor No. 17.

Coating Liquid (23):

| | |
|---|---|
| Charge generating material of the following formula: | 5 parts |

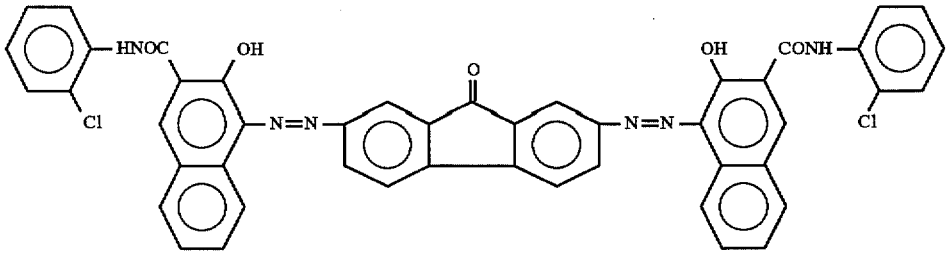

| | |
|---|---|
| Tetrahydrofuran | 400 parts |

EXAMPLE 15

Example 5 was repeated in the same manner as described except that a coating liquid (21) having the composition shown below for the formation of an intermediate layer was applied before the formation of the charge transfer layer to obtain an electrophotographic photoconductor No. 15. The intermediate layer had a thickness of 0.3 μm.

Coating Liquid (21):

| | |
|---|---|
| Alcohol-soluble Nylon (AMYLAN CM-8000 manufactured by Toray Inc.) | 3 parts |

Coating Liquid (24):

| | |
|---|---|
| Polymeric charge transporting material of the following formula (IP: 5.77 eV): | 3 parts |

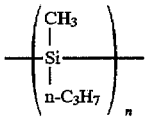

| | |
|---|---|
| Tetrahydrofuran | 400 parts |

EXAMPLE 18

Example 2 was repeated in the same manner as described except that the charge generation layer was formed by simultaneously spraying coating liquids (25) and (26) having the compositions shown below through two spray nozzles at the same spraying rate, thereby to obtain an electrophotographic photoconductor No. 18.

Coating Liquid (25):

| | |
|---|---|
| Charge generating material of the following formula: | 1 part |

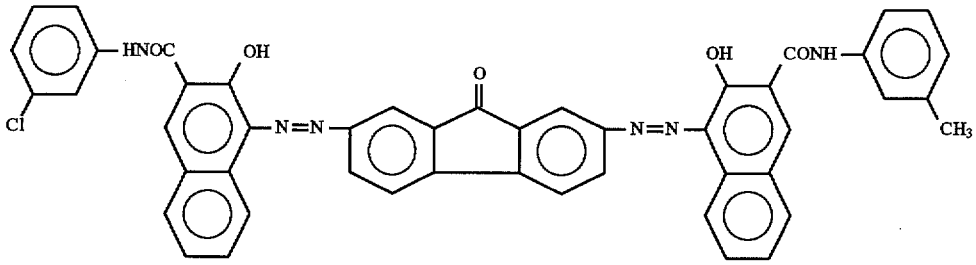

| | |
|---|---|
| Tetrahydrofuran | 100 parts |
| Cyclohexanone | 50 parts |

Coating Liquid (26):

| | |
|---|---|
| Polymeric charge transporting material of the following formula (IP: 5.62 eV): | 1 part |

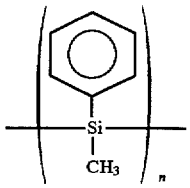

| | |
|---|---|
| Tetrahydrofuran | 400 parts |
| Cyclohexanone | 50 parts |

The electrophotographic photoconductors No. 1 and Comp. Nos. 1 and 2 were tested for the photoconductive characteristics using a static copying tester (Paper Analyzer Model SP-428 manufactured by Kawaguchi Electro Work Co., Ltd.) in the manner given below.

The photoconductor is subjected to a corona discharge at −5.2 kV for 15 seconds and then dark-decayed. When a surface potential of −800 V is reached, the photoconductor is irradiated with light of a tungsten lamp of 4 lux. The, the exposure $E_{400}$ (lux·sec) required to reduce the surface potential to −400 V is measured. Further, the surface potential $V_{30}$ (V) after 30 seconds irradiation with the tungsten lamp is measured. The photoconductor is thereafter subjected simultaneously to the corona discharge and exposure treatments for 1 hour. After the fatigue treatment, the photoconductor is tested for the characteristics thereof in the same manner as above. The results are shown in Table 1.

The electrophotographic photoconductors Nos. 2–4 and 9–12 were tested for the photoconductive characteristics using a device disclosed in JP-A-60-100167 in the manner given below.

The photoconductor is subjected to a corona discharge at −5.8 kV for 15 seconds and then dark-decayed. When a surface potential of −800 V is reached, the photoconductor is irradiated with light of a tungsten lamp of 5 lux. The, the exposure $E_{400}$ (lux·sec) required to reduce the surface potential to −400 V is measured. Further, the surface potential $V_{30}$ (V) after 30 seconds irradiation with the tungsten lamp is measured. The photoconductor is thereafter subjected simultaneously to the corona discharge and exposure treatments for 2 hours. After the fatigue treatment, the photoconductor is tested for the characteristics thereof in the same manner as above. The results are shown in Table 1.

The photoconductors Nos. 5–8, 15 and 16 were subjected to a peeling test as follows: The photosensitive layer of the photoconductor is cut with a knife into a matrix of 25 sections. A pressure-sensitive adhesive tape is applied on the cut surface and is then peeled. The number of the sections separated from the support is counted. The results are shown in Table 2.

The photoconductors Nos. 2, 13 and 14 were tested for an image reproduction test as follows: The photoconductor is mounted on electrophotographic apparatus RICOPY FT5510 manufactured by Ricoh Company Ltd. and modified to be adapted for negative charging operation). The apparatus is allowed to continuously run for obtaining 100,000 copies. The reproduced images obtained at 10 and 100,000 copying operation are evaluated. The amount of the thickness of the photoconductor reduced upon the 100,000 copying operation is also measured. The results are summarized in Table 3.

The coating liquids for the formation of the charge generation layers used in Examples 1, 2, 17 and 18 were tested for stability as follows: The coating liquid is applied 1 day after the preparation thereof to check the coating. The coating liquid is also applied 2 months after the preparation thereof to check the coating. The results are shown in Table 4.

TABLE 1

| | Initial | | After Fatigue | |
|---|---|---|---|---|
| Photoconductor No. | $E_{400}$ (lux·sec) | $V_{30}$ (-V) | $E_{400}$ (lux·sec) | $V_{30}$ (-V) |
| 1 | 0.81 | 2 | 0.83 | 5 |
| Comp. 1 | 1.92 | 10 | 3.52 | 63 |
| Comp. 2 | 1.56 | 7 | 1.96 | 43 |
| 2 | 0.62 | 0 | 0.63 | 4 |
| 3 | 0.70 | 1 | 0.68 | 6 |
| 4 | 0.92 | 0 | 0.95 | 15 |
| 9 | 0.60 | 0 | 0.61 | 2 |
| 10 | 0.65 | 1 | 0.69 | 8 |

TABLE 1-continued

| Photoconductor No. | Initial $E_{400}$ (lux·sec) | Initial $V_{30}$ (-V) | After Fatigue $E_{400}$ (lux·sec) | After Fatigue $V_{30}$ (-V) |
|---|---|---|---|---|
| 11 | 0.93 | 1 | 0.95 | 7 |
| 12 | 0.53 | 2 | 0.50 | 2 |

TABLE 2

| Photoconductor | Number of Peeled Sections |
|---|---|
| 5 | 1 |
| 6 | 6 |
| 7 | 2 |
| 8 | 5 |
| 15 | 0 |
| 16 | 0 |

TABLE 3

| Photoconductor | Image Condition 10th copy | Image Condition $10^5$th copy | Decreased Amount (μm) |
|---|---|---|---|
| 2 | good | good | 1.0 |
| 13 | good | good | 0.5 |
| 14 | good | * | 1.7 |

*Abnormal image due to abrasion of photoconductor is slightly found.

TABLE 4

| Example No. | Initial Coating Liquid | Initial Coated Layer | After 2 Months Coating Liquid | After 2 Months Coated Layer |
|---|---|---|---|---|
| 1 | good | good | *1 | *2 |
| 2 | good | good | *1 | *2 |
| 17 | good | good | good | good |
| 18 | good | gooed | good | good |

*1: An aggregate is slightly formed.
*2: A surface defect is slightly found.

EXAMPLE 19

On an aluminum-deposited surface of a polyethylene terephthalate film were successively applied and dried a coating liquid (27) for a charge generation layer and a coating liquid (28) for a charge transport layer having the compositions shown below, thereby obtaining an electrophotographic photoconductor No. 19 having the charge generation layer with a thickness of 0.2 μm and the charge transport layer with a thickness of 18 μm.

Coating Liquid (27):

Charge generating material of the following formula: 3 parts

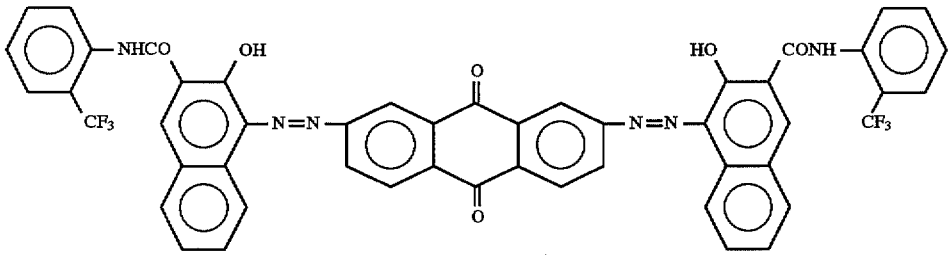

Polymeric charge transporting material of the following formula: 3 parts

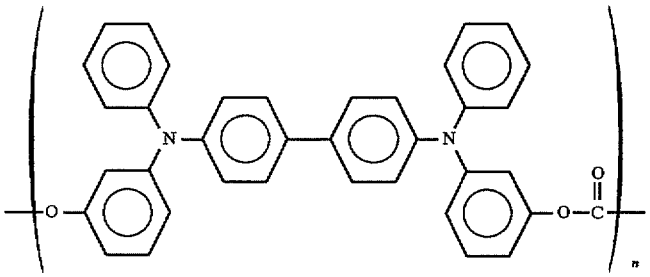

Cyclohexanone 180 parts
2-Butanone 75 parts

Coating Liquid (28):

| | |
|---|---|
| Polymeric charge transporting material of the following formula: | 10 parts |

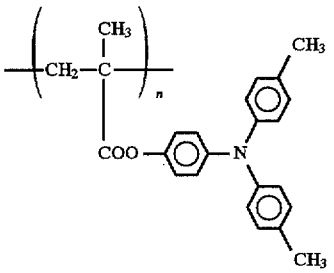

| | |
|---|---|
| Charge transporting material of the following formula: | 5 parts |

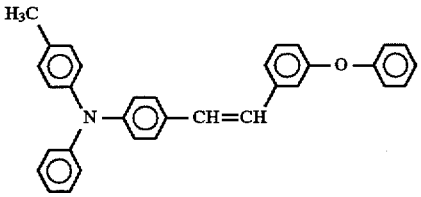

-continued

| | |
|---|---|
| Methylene chloride | 70 parts |

Comparative Example 3

Example 19 was repeated in the same manner as described except that polyvinyl butyral (ESLECK BM-S manufactured by Sekisui Kagaku Kogyo K.K.) was substituted for the polymeric charge transporting material used for the formation of the charge generation layer, thereby to obtain an electrophotographic photoconductor No. Comp. 3.

EXAMPLE 20

On an aluminum-deposited surface of a polyethylene terephthalate film were successively applied and dried a coating liquid (29) for a charge generation layer and a coating liquid (30) for a charge transport layer having the compositions shown below, thereby obtaining an electrophotographic photoconductor No. 20 having the charge generation layer with a thickness of 0.3 μm and the charge transport layer with a thickness of 23 μm.

Coating Liquid (29):

| | |
|---|---|
| Charge generating material of the following formula: | 3 parts |

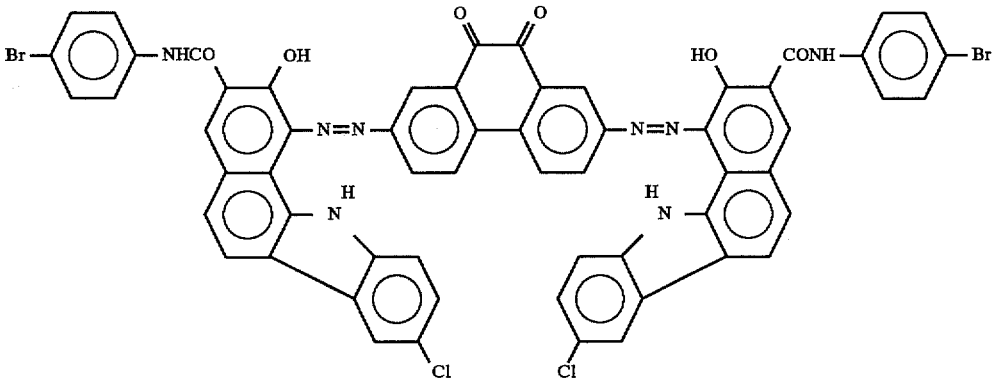

| | |
|---|---|
| Polymeric charge transporting material of the following formula: | 3 parts |

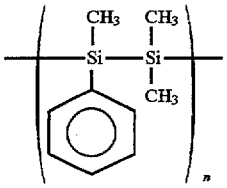

| | |
|---|---|
| Charge transporting material of the following formula: | 2 parts |

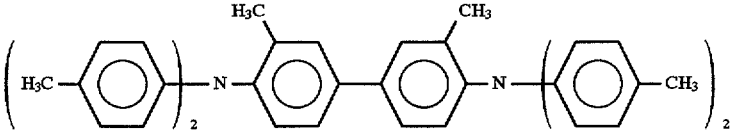

-continued

| | |
|---|---|
| Tetrahydrofuran | 180 parts |
| 2-Butanone | 100 parts |

Coating Liquid (30):

| | |
|---|---|
| Polymeric charge transporting material of the following formula: | 10 parts |

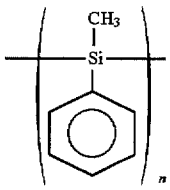

| | |
|---|---|
| Tetrahydrofuran | 80 parts |

EXAMPLE 21

Example 20 was repeated in the same manner as described except that the polymer of the formula shown below was substituted for the polymeric charge transporting material used for the formation of the charge transport layer, thereby to obtain an electrophotographic photoconductor No. 21.

polymeric charge transporting material used for the formation of the charge transport layer, thereby to obtain an electrophotographic photoconductor No. Comp. 4.

EXAMPLE 22

On an aluminum plate with a thickness of 0.2 mm were successively applied and dried a coating liquid (31) for a charge generation layer, a coating liquid (32) for an intermediate layer and a coating liquid (33) for a charge transport layer having the compositions shown below, thereby obtaining an electrophotographic photoconductor No. 22 having the charge generation layer with a thickness of 23 μm, the intermediate layer with a thickness of 0.3 μm and the charge transport layer with a thickness of 20 μm.

Coating Liquid (31):

| | |
|---|---|
| Charge generating material of the following formula: | 4 parts |

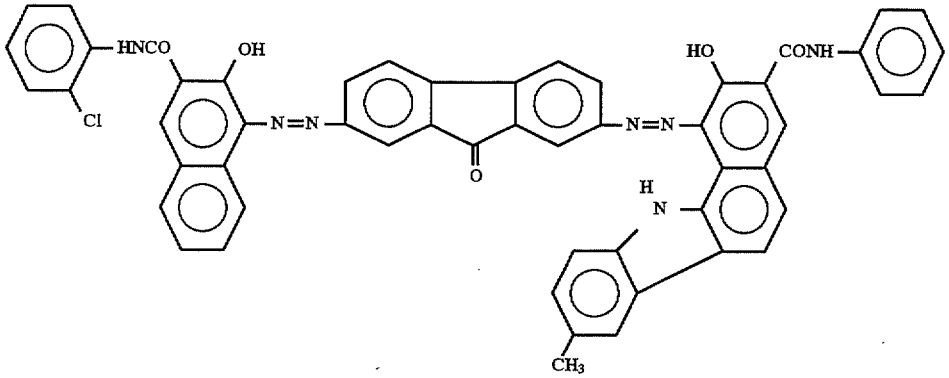

| | |
|---|---|
| Polymeric charge transporting material of the following formula: | 2 parts |

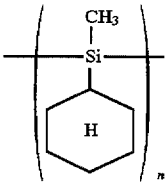

| | |
|---|---|
| Cyclohexanone | 200 parts |
| Methylcyclohexane | 90 parts |

Comparative Example 4

Example 20 was repeated in the same manner as described except that a phenoxy resin (VYHH manufactured by Union Carbide Corporation) was substituted for the Coating Liquid (33):

| | |
|---|---|
| Charge trasnsporting material of the following formula: 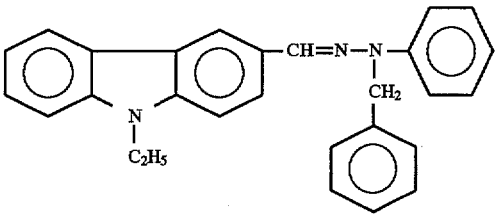 | 10 parts |
| Polyvinyl butyral (ESLECK BL-1 manufactured by Sekisui Kagaku Kogyo K.K.) | 6 parts |
| 2-Butanone | 50 parts |

Coating Liquid (33):

| | |
|---|---|
| Polymeric charge transporting material of the following formula: 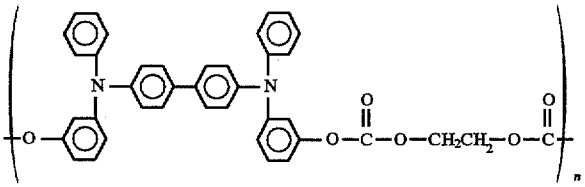 | 10 parts |
| Methylene chloride | 80 parts |

EXAMPLE 23

On an aluminum plate with a thickness of 0.2 mm were successively applied and dried a coating liquid (34) for a charge transport layer, a coating liquid (35) for a charge generation layer and a coating liquid (36) for a protecting layer having the compositions shown below, thereby obtaining an electrophotographic photoconductor No. 23 having the charge transport layer with a thickness of 20 μm, the charge generation layer with a thickness of 0.4 μm and the protecting layer with a thickness of 3 μm.

Coating Liquid (34):

| | |
|---|---|
| Polymeric charge transporting material of the following formula: 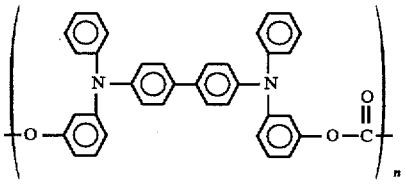 | 10 parts |

-continued

| | |
|---|---|
| Charge transporting material of the following formula: 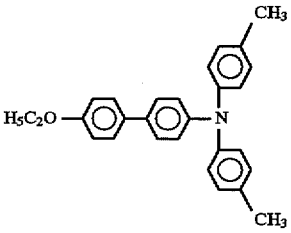 | 12 parts |
| Tetrahydrofuran | 80 parts |

Coating Liquid (35):

Charge generating material of the following formula: 3 parts

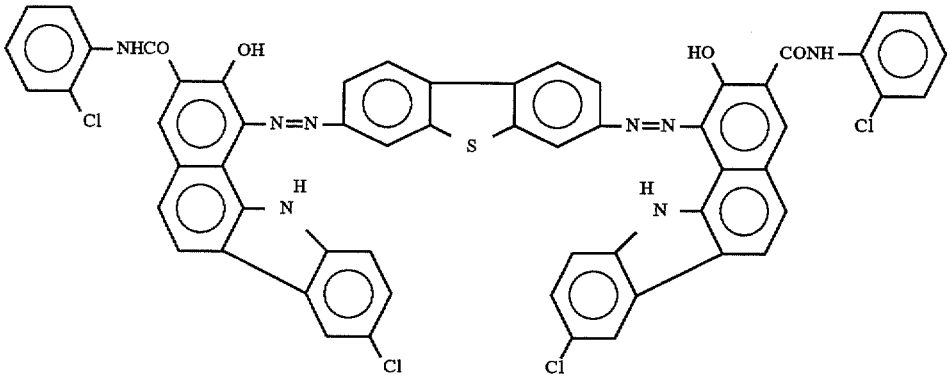

Polymeric charge transporting material of the following formula: 4 parts

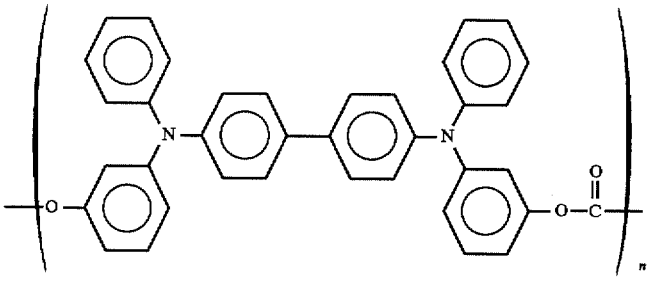

| | |
|---|---|
| Tetrahydrofuran | 100 parts |
| Cyclohexanone | 100 parts |

Coating Liquid (36):

| | |
|---|---|
| Tin oxide containing 10% antimony oxide | 30 parts |
| Styrene-methacrylic acid-N-methylol methacrylamide resin | 10 parts |
| Toluene | 80 parts |
| n-Butanol | 70 parts |

Comparative Example 5

Example 23 was repeated in the same manner as described except that polysulfone (P-1700 manufactured by Nissan Chemical Inc.) was substituted for the polymeric charge transporting material used for the formation of the charge generation layer, thereby to obtain an electrophotographic photoconductor No. Comp. 5.

EXAMPLE 24

On an aluminum plate with a thickness of 0.2 mm were successively applied and dried a coating liquid (37) for an undercoat layer, a coating liquid (38) for a charge transport layer and a coating liquid (39) for charge generation layer having the compositions shown below, thereby obtaining an electrophotographic photoconductor No. 24 having the undercoat layer with a thickness of 0.5 μm, the charge transport layer with a thickness of 24 μm and the charge generation layer with a thickness of 0.3 μm.

Coating Liquid (37):

| | |
|---|---|
| Water-soluble polyvinyl acetal (W-101 manufactured by Sekisui Kagaku Kogyo K. K., 10% aqueous solution) | 15 parts |
| Water | 20 parts |
| Methanol | 50 parts |

Coating Liquid (38):

Polycarbonate (PANLITE C-1400 manufactured by Teijin Kasei K.K.) 6 parts

Polymeric charge generating material of the following formula: 10 parts

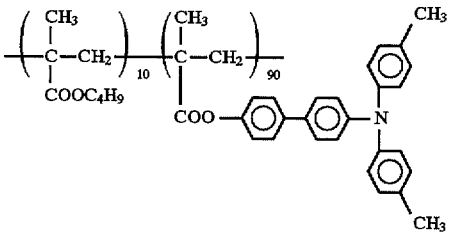

Tetrahydrofuran 80 parts

Coating Liquid (39):

Charge generating material of the following formula: 3 parts
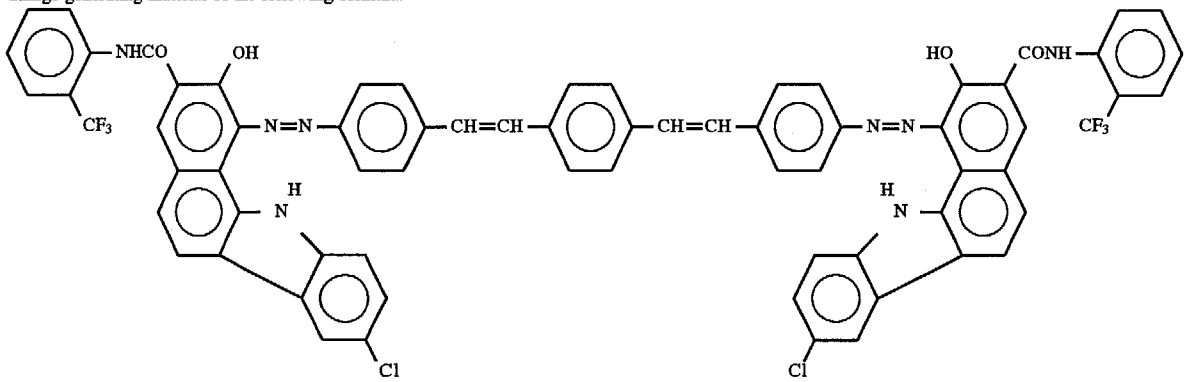
Charge transporting material of the following formula: 2 parts
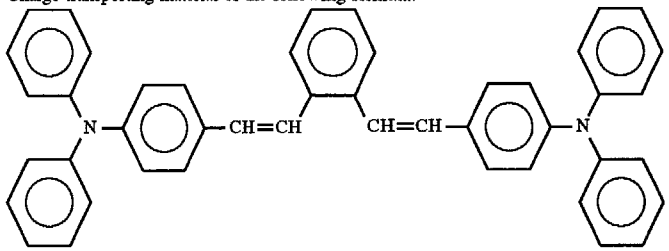
Polymeric charge transporting material of the following formula: 3 parts
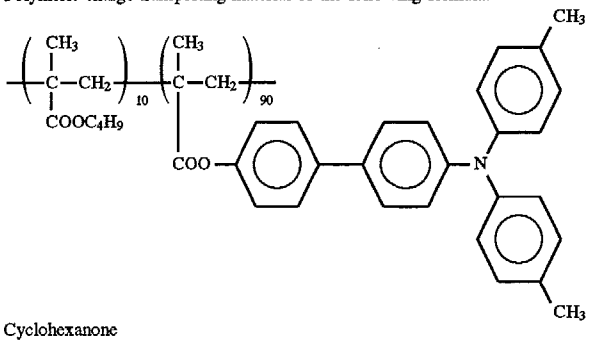
| | |
|---|---|
| Cyclohexanone | 200 parts |
| 4-Methyl-2-pentanone | 90 parts |

EXAMPLE 25

On an aluminum plate with a thickness of 0.2 mm were successively applied and dried a coating liquid (40) for a charge generation layer, a coating liquid (41) for an intermediate layer and a coating liquid (42) for a charge transport layer having the compositions shown below, thereby obtaining an electrophotographic photoconductor No. 25 having the charge generation layer with a thickness of 23 μm, the intermediate layer with a thickness of 0.3 μm and the charge transport layer with a thickness of 20 μm.

Coating Liquid (40):

| | |
|---|---|
| Polymeric charge transporting material of the following formula: 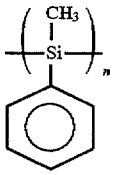 | 10 parts |
| Toluene | 80 parts |

Coating Liquid (41):

| | |
|---|---|
| Charge transporting material of the following formula: 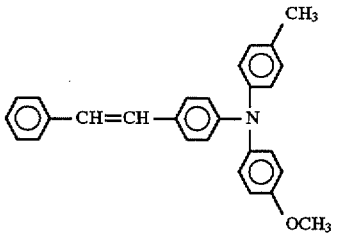 | 15 parts |
| Polyethylene glycol (PEG 6000S manufactured by Sanyo Kasei K.K.) | 3 parts |
| 2-Butanone | 150 parts |

Coating Liquid (42):

| | |
|---|---|
| Charge transporting material of the following formula: 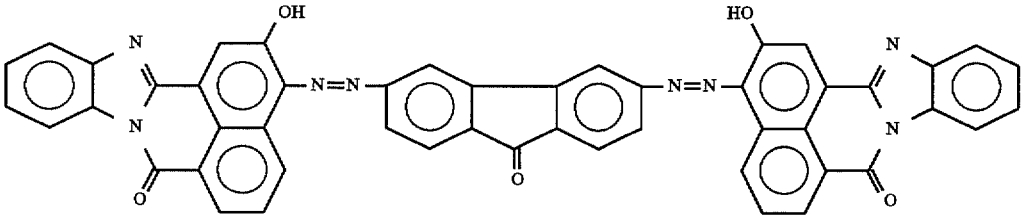 | 4 parts |
| Polymeric charge transporting material of the following formula: 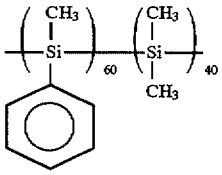 | 2 parts |
| Cyclohexanone | 200 parts |
| Methylcyclohexane | 90 parts |

The electrophotographic photoconductors Nos. 19–25 and Comp. Nos. 3–5 were tested for the photoconductive characteristics using a static copying tester (Paper Analyzer Model SP-428 manufactured by Kawaguchi Electro Work Co., Ltd.) in the manner given below.

The photoconductor is subjected to a corona discharge at +5.6 kV or −5.3 kV for 20 seconds. The potential $V_m$ (V) is measured 20 seconds after the commencement of the charging. The photoconductor is then dark-decayed and the potential $V_0$ (V) thereof is measured after the 20 seconds dark decay. The photoconductor is irradiated with light of a tungsten lamp of 6 lux. The residual potential $V_R$ (V) is measured after the 20 seconds exposure. Then, the exposure $E_{1/2}$ (lux·sec) required to reduce the surface potential to a half of $V_0$ is measured. The photoconductor is thereafter subjected simultaneously to the corona discharge and exposure treatments for 30 minutes. After the fatigue treatment, the photoconductor is tested for the characteristics thereof in the same manner as above. The results are shown in Table 5. In Table 5, $V_0/V_m$ represents a potential retentivity.

TABLE 5

| | Initial | | | After Fatigue | | |
|---|---|---|---|---|---|---|
| Photoconductor No. | $V_0/V_m$ | $E_{1/2}$ (lux · sec) | $V_R$ (V) | $V_0/V_m$ | $E_{1/2}$ (lux · sec) | $V_R$ (V) |
| 19 | 0.83 | 1.24 | 0 | 0.81 | 1.26 | 0 |
| Comp. 3 | 0.82 | 1.83 | −2 | 0.80 | 2.03 | −10 |

TABLE 5-continued

| Photoconductor No. | Initial $V_0/V_m$ | Initial $E_{1/2}$ (lux · sec) | Initial $V_R$ (V) | After Fatigue $V_0/V_m$ | After Fatigue $E_{1/2}$ (lux · sec) | After Fatigue $V_R$ (V) |
|---|---|---|---|---|---|---|
| 20 | 0.80 | 0.74 | 0 | 0.79 | 0.73 | 0 |
| 21 | 0.83 | 0.72 | 0 | 0.81 | 0.71 | −1 |
| Comp. 4 | 0.88 | 1.08 | −8 | 0.86 | 1.10 | −25 |
| 22 | 0.84 | 0.66 | 0 | 0.83 | 0.61 | −1 |
| 23 | 0.82 | 0.81 | 0 | 0.81 | 0.80 | 1 |
| Comp. 5 | 0.84 | 1.50 | 6 | 0.83 | 1.68 | 34 |
| 24 | 0.81 | 1.11 | 0 | 0.78 | 1.07 | 0 |
| 25 | 0.84 | 0.19 | 1 | 0.81 | 0.75 | 0 |

EXAMPLE 26

Example 19 was repeated in the same manner as described except that the charge generation layer was formed by simultaneously spraying coating liquids (43) and (44) having the compositions shown below through two spray nozzles at the same spraying rate, thereby to obtain an electrophotographic photoconductor No. 26.

Coating Liquid (43):

Charge generating material of the following formula:

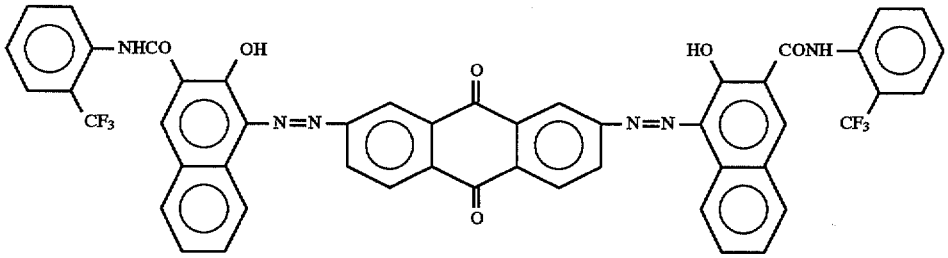

3 parts

Cyclohexanone 180 parts
2-Butanone 75 parts

Coating Liquid (44):

Polymeric charge transporting material of the following formula:

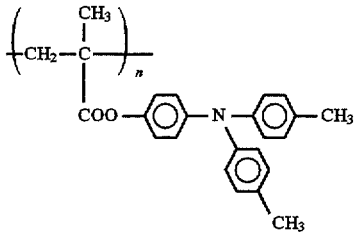

3 parts

Cyclohexanone 180 parts
2-Butanone 75 parts

EXAMPLE 27

Example 20 was repeated in the same manner as described except that the charge generation layer was formed by simultaneously spraying coating liquids (45) and (46) having the compositions shown below through two spray nozzles at the same spraying rate, thereby to obtain an electrophotographic photoconductor No. 27.

Coating Liquid (45):

| | |
|---|---|
| Charge generating material of the following formula: | |
| 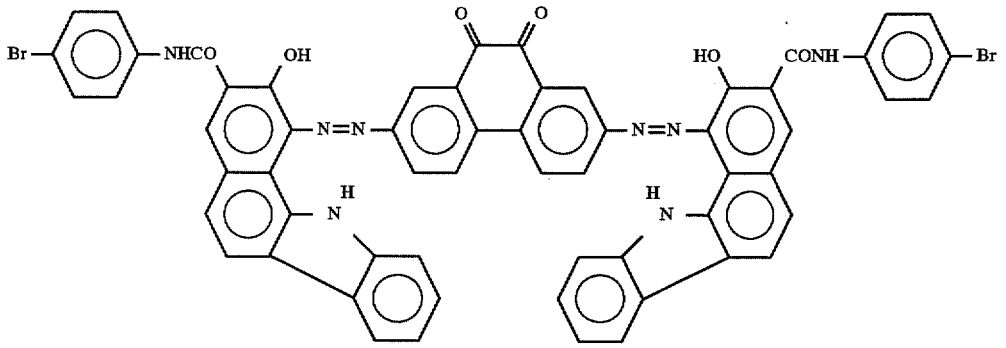 | 3 parts |
| Tetrahydrofuran | 180 parts |
| 2-Butanone | 100 parts |

Coating Liquid (46):

| | |
|---|---|
| Polymeric charge transporting material of the following formula: | |
| 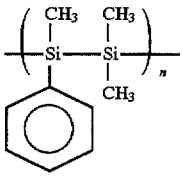 | 3 parts |
| Tetrahydrofuran | 180 parts |
| 2-Butanone | 100 parts |

EXAMPLE 28

Example 22 was repeated in the same manner as described except that the charge generation layer was formed by simultaneously spraying coating liquids (47) and (48) having the compositions shown below through two spray nozzles at the same spraying rate, thereby to obtain an electrophotographic photoconductor No. 28.

Coating Liquid (47):

| | |
|---|---|
| Charge generating material of the following formula: 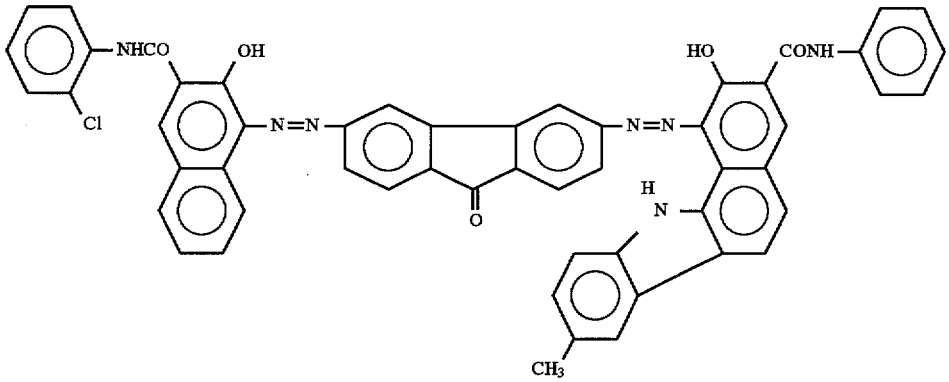 | 4 parts |
| Cyclohexanone | 200 parts |
| Methylcyclohexane | 90 parts |

Coating Liquid (48):

| | |
|---|---|
| Polymeric charge transporting material of the following formula: 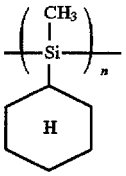 | 3 parts |
| Cyclohexanone | 180 parts |
| Methylcyclohexane | 90 parts |

The coating liquids for the formation of the charge generation layers used in Examples 26–28 and Comparative Examples 3–5 were tested for stability as follows: The coating liquid is applied 1 day after the preparation thereof to check the coating. The coating liquid is also applied 3 months after the preparation thereof to check the coating. The results are shown in Table 6.

TABLE 6

| | Initial | | After 2 Months | |
|---|---|---|---|---|
| Example No. | Coating Liquid | Coated Layer | Coating Liquid | Coated Layer |
| 26 | good | good | good | good |
| 27 | good | good | good | good |
| 28 | good | good | good | good |
| Comp. 3 | good | good | *1 | *2 |
| Comp. 4 | good | good | *1 | *2 |
| Comp. 5 | good | good | *3 | *4 |

*1: An aggregate is formed.
*2: A surface defect is found.
*3: coating liquid is gelled.
*4: Impossible to form a coated layer.

EXAMPLE 29

On an aluminum-deposited surface of a polyethylene terephthalate film were successively applied and dried a coating liquid (49) for a charge generation layer and a coating liquid (50) for a charge transport layer having the compositions shown below, thereby obtaining an electrophotographic photoconductor No. 29 having the charge generation layer with a thickness of 0.2 μm and the charge transport layer with a thickness of 20 μm.

Coating Liquid (49):

| | |
|---|---|
| Charge generating material of the following formula: | 5 parts |

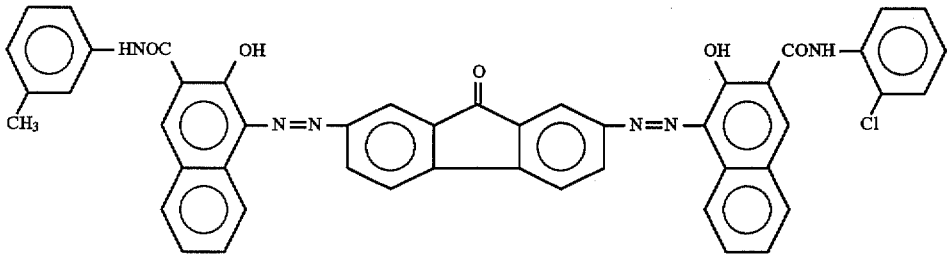

| | |
|---|---|
| Polymeric charge transporting material of the following formula: | 3 parts |

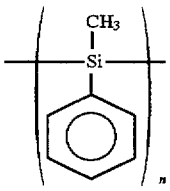

| | |
|---|---|
| Tetrahydrofuran | 400 parts |

Coating Liquid (50):

| | |
|---|---|
| Charge transporting material of the following formula: | 6 parts |

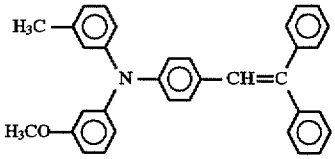

| | |
|---|---|
| Polycarbonate (PANLITE L-1250 manufactured by Teijin Kasei K. K.) | 10 parts |

-continued

| | |
|---|---|
| Methylene chloride | 100 parts |

EXAMPLE 30

On an aluminum-deposited surface of a polyethylene terephthalate film were successively applied and dried a coating liquid (51) for a charge generation layer and a coating liquid (52) for a charge transport layer having the compositions shown below, thereby obtaining an electrophotographic photoconductor No. 30 having the charge generation layer with a thickness of 0.3 μm and the charge transport layer with a thickness of 25 μm.

Coating Liquid (51):

| | |
|---|---|
| Charge generating material of the following formula: | 5 parts |

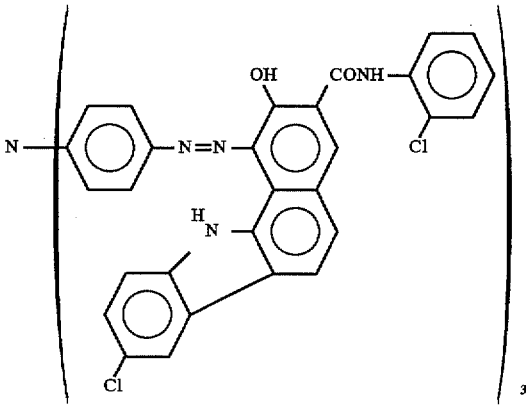

| | |
|---|---|
| Polymeric charge transporting material of the following formula: | 5 parts |

-continued

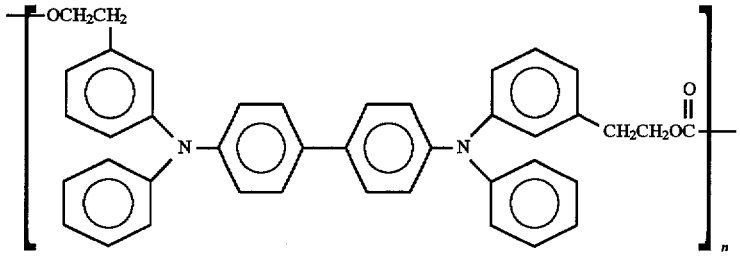

| | |
|---|---|
| Polyvinyl butyral (ESLECK BL-1 manufactured by Sekisui Kagaku Kogyo K.K.) | 1 parts |
| Cyclohexanone | 150 parts |
| 2-Butanone | 100 parts |

Coating Liquid (52):

| | |
|---|---|
| Charge transporting material of the following formula: | 5 parts |

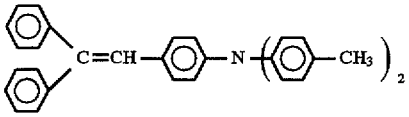

| | |
|---|---|
| Polycarbonate (PANLITE L-1300 manufactured by Teijin Kasei K. K.) | 10 parts |
| Tetrahydrofuran | 90 parts |

EXAMPLE 31

On a polyethylene terephthalate film provided with a Hastelloy conductive layer were successively applied and dried a coating liquid (53) for an undercoat layer, a coating liquid (54) for a charge generation layer and a coating liquid (55) for a charge transport layer having the compositions shown below, thereby obtaining an electrophotographic photoconductor No. 31 having the undercoat layer with a thickness of 0.2 μm, the charge generation layer with a thickness of 0.3 μm and the charge transport layer with a thickness of 22 μm.

Coating Liquid (53):

| | |
|---|---|
| Alcohol-soluble Nylon (AMYLAN CM-8000 manufactured by Toray Inc.) | 3 parts |
| Methanol | 60 parts |
| Butanol | 40 parts |

Coating Liquid (54):

| | |
|---|---|
| Charge generating material of the following formula: | 4 parts |

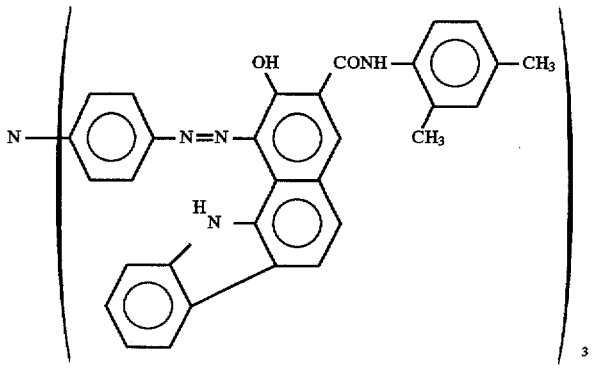

| | |
|---|---|
| Polymeric charge transporting material of the following formula: | 6 parts |

-continued

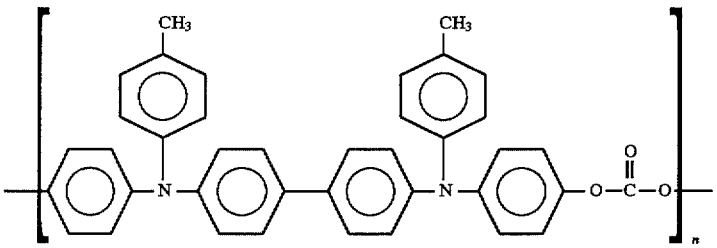

| | |
|---|---|
| Cyclohexanone | 300 parts |

Coating Liquid (55):

| | |
|---|---|
| Charge transporting material of the following formula: | 7 parts |

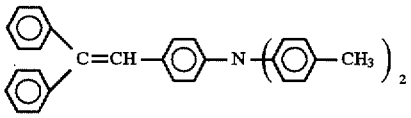

| | |
|---|---|
| Polycarbonate (YUPILON Z-200 manufactured by Misubishi Gas Chamical Inc.) | 10 parts |
| Toluene | 150 parts |

EXAMPLE 32

Over an outer surface of an aluminum cylindrical support having a diameter of 80 mm were successively applied and dried a coating liquid (56) for an undercoat layer, a coating liquid (57) for a charge generation layer and a coating liquid (58) for a charge transport layer having the compositions shown below, thereby obtaining an electrophotographic photoconductor No. 32 having the undercoat layer with a thickness of 0.5 μm, the charge generation layer with a thickness of 0.3 μm and the charge transport layer with a thickness of 28 μm.

Coating Liquid (56):

| | |
|---|---|
| Titanium dioxide | 5 parts |
| Polyester (BYLON 200 manufactured by Toyo Boseki K. K.) | 2 parts |
| 2-Butanone | 110 parts |
| 4-Methyl-2-pentanone | 70 parts |

Coating Liquid (57):

| | |
|---|---|
| Charge generating material of the following formula: | 1 part |

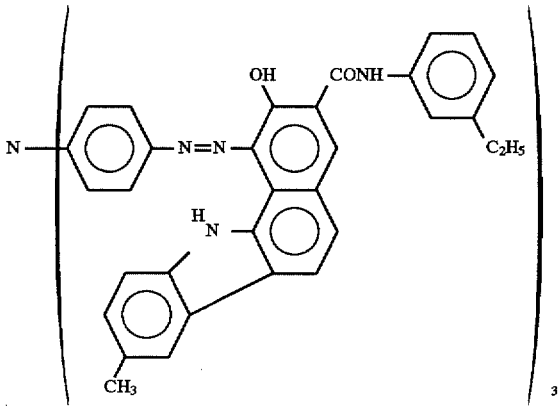

| | |
|---|---|
| Polymeric charge transporting material of the following formula: | 1 part |

-continued

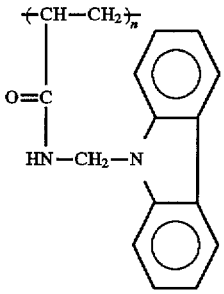

| | |
|---|---|
| Tetrahydrofuran | 100 parts |
| Cyclohexanone | 50 parts |

Coating Liquid (58):

| | |
|---|---|
| Charge transporting material of the following formula: | 8 parts |

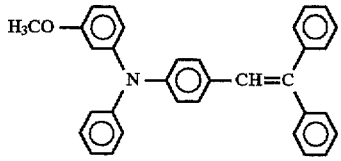

| | |
|---|---|
| Polycarbonate (LEXAN L-141 manufactured by General Electric Inc.) | 10 parts |
| Methylene chloride | 200 parts |

EXAMPLE 33

Example 32 was repeated in the same manner as described except that a coating liquid (59) was substituted for the coating liquid (58) for the formation of the charge transport layer to obtain an electrophotographic photoconductor No. 33.

Coating Liquid (59):

| | |
|---|---|
| Charge transporting material of the following formula: | 6 parts |

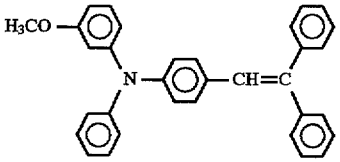

| | |
|---|---|
| Polycarbonate (LEXAN L-141 manufactured by General Electric Inc.) | 10 parts |
| Methylene chloride | 200 parts |

EXAMPLE 34

Example 32 was repeated in the same manner as described except that a coating liquid (60) was substituted for the coating liquid (58) for the formation of the charge transport layer to obtain an electrophotographic photoconductor No. 34.

Coating Liquid (60):

| | |
|---|---|
| Charge transporting material of the following formula: | 9 parts |

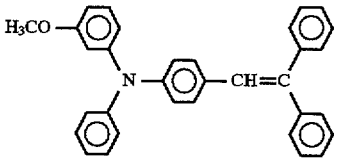

| | |
|---|---|
| Polycarbonate (LEXAN L-141 manufactured by General Electric Inc.) | 10 parts |
| Methylene chloride | 200 parts |

EXAMPLE 35

Example 32 was repeated in the same manner as described except that a coating liquid (61) was substituted for the coating liquid (58) for the formation of the charge transport layer to obtain an electrophotographic photoconductor No. 35.

Coating Liquid (61):

| | |
|---|---|
| Charge transporting material of the following formula: | 11 parts |

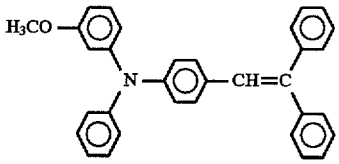

| | |
|---|---|
| Polycarbonate (LEXAN L-141 manufactured by General Electric Inc.) | 10 parts |
| Methylene chloride | 200 parts |

Comparative Example 6

Example 29 was repeated in the same manner as described except that the polymeric charge transporting material was not used at all in the coating liquid (49) to obtain an electrophotographic photoconductor No. Comp. 6.

Comparative Example 7

Example 30 was repeated in the same manner as described except that the polymeric charge transporting material was not used at all in the coating liquid (51) to obtain an electrophotographic photoconductor No. Comp. 7.

Comparative Example 8

Example 31 was repeated in the same manner as described except that the coating liquid (54) was replaced by a coating liquid (62) having the composition shown below to obtain an electrophotographic photoconductor No. Comp. 8. Coating Liquid (62):

Charge generating material of the following formula: 4 parts

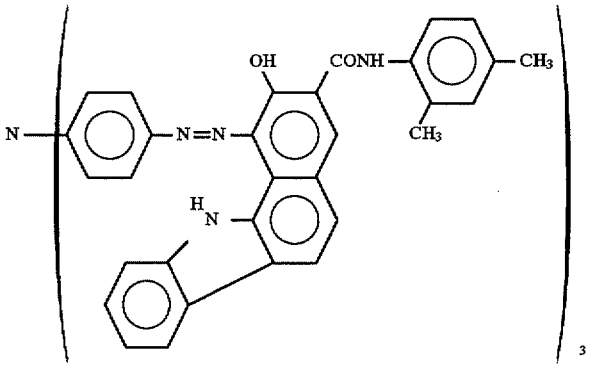

Charge transporting material of the following formula: 6 parts

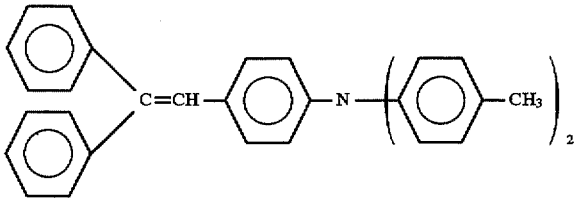

Cyclohexanone 300 parts

The electrophotographic photoconductors Nos. 29–31 and Comp. Nos. 6–8 were tested for the photoconductive characteristics using a static copying tester (Paper Analyzer Model SP-428 manufactured by Kawaguchi Electro Work Co., Ltd.) in the manner given below.

The photoconductor is subjected to a corona discharge at −5.2 kV for 15 seconds and then dark-decayed. When a surface potential of −800 V is reached, the photoconductor is irradiated with light of a tungsten lamp of 4 lux. The, the exposure $E_{400}$ (lux·sec) required to reduce the surface potential to −400 V is measured. Further, the surface potential $V_{30}$ (V) after 30 seconds irradiation with the tungsten lamp is measured. The results are shown in Table 1.

The electrophotographic photoconductors Nos. 2–4 and 9–12 were tested for the photoconductive characteristics using a device disclosed in JP-A-60-100167 in the manner given below.

The photoconductor is subjected to a corona discharge at −5.8 kV for 15 seconds and then dark-decayed. When a surface potential of −800 V is reached, the photoconductor is irradiated with light of a tungsten lamp of 5 lux. The, the exposure $E_{400}$ (lux·sec) required to reduce the surface potential to −400 V is measured. Further, the surface potential $V_{30}$ (V) after 30 seconds irradiation with the tungsten lamp is measured. The results are shown in Table 7.

The photoconductors Nos. 5–8, 15 and 16 were subjected to a peeling test as follows: The photosensitive layer of the photoconductor is cut with a knife into a matrix of 25 sections. A pressure-sensitive adhesive tape is applied on the cut surface and is then peeled. The number of the sections separated from the support is counted. The results are shown in Table 2.

The photoconductors Nos. 32–35 were tested for an image reproduction test as follows: The photoconductor is mounted on electrophotographic apparatus IMAGIO 530 manufactured by Ricoh Company Ltd. The apparatus is allowed to continuously run for obtaining 50,000 copies. The reproduced images obtained at 10 and 50,000 copying operation are evaluated. The results are summarized in Table 8.

TABLE 7

| Photoconductor No. | $E_{400}$ (lux · sec) | $V_{30}$ (−V) |
|---|---|---|
| 29 | 0.8 | 0 |
| Comp. 6 | 2.2 | 30 |
| 30 | 1.0 | 0 |
| Comp. 7 | 3.1 | 60 |
| 31 | 0.7 | 0 |
| Comp. 8 | 1.5 | 43 |

TABLE 8

| Photoconductor No. | 10th copy | $5 \times 10^4$th copy |
|---|---|---|
| 32 | good | good |
| 33 | good | good |
| 34 | good | * |
| 35 | good | * |

*Abnormal image due to abrasion of photoconductor is found (fouling of background and formation of streaks).

EXAMPLE 36

On an aluminum plate with a thickness of 0.2 mm were successively applied and dried a coating liquid (63) for a charge generation layer, a coating liquid (64) for an intermediate layer and a coating liquid (65) for a charge transport layer having the compositions shown below, thereby obtaining an electrophotographic photoconductor No. 36 having the charge generation layer with a thickness of 0.2 μm, the intermediate layer with a thickness of 0.3 μm and the charge transport layer with a thickness of 25 μm.

Coating Liquid (63):

Charge generating material of the following formula: 4 parts

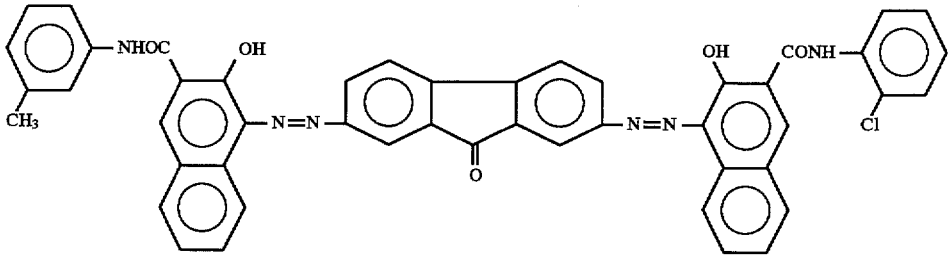

Polyvinyl butyral (ESLECK BH-3 manufactured by Sekisui Kagaku Kogyo K.K.) 2 parts
Cyclohexanone 200 parts
Methylcyclohexane 90 parts Coating Liquid (64):

Charge transporting material of the following formula: 5 parts

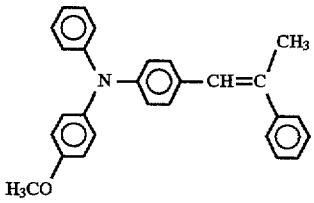

Polyester (BYLON 300 manufactured by Toyo Boseki K. K.) 3 parts
2-Butanone 150 parts Coating Liquid (65):

Polymeric charge transporting material of the following formula: 10 parts

-continued

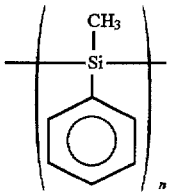

Polycarbonate (LEXAN L-141 manufactured by General Electric Inc.) 9 parts
Methylene chloride 80 parts Comparative Example 9

Example 36 was repeated in the same manner as described except that the intermediate layer was not formed to obtain an electrophotographic photoconductor No. Comp. 9.

EXAMPLE 37

On an aluminum plate with a thickness of 0.2 mm were successively applied and dried a coating liquid (66) for a charge generation layer, a coating liquid (67) for an intermediate layer and a coating liquid (68) for a charge transport layer having the compositions shown below, thereby obtaining an electrophotographic photoconductor No. 37 having the charge generation layer with a thickness of 23 μm, the intermediate layer with a thickness of 0.3 μm and the charge transport layer with a thickness of 20 μm.

Coating Liquid (66):

Polymeric charge generating material of the following formula: 10 parts

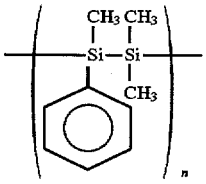

-continued

| | |
|---|---|
| Polycarbonate (YUPILON Z-300 manufactured by Mitsubishi Gas Chemical Inc.) | 6 parts |
| Methylene chloride | 80 parts |

Coating Liquid (67):

| | |
|---|---|
| Charge transporting material of the following formula: | 5 parts |

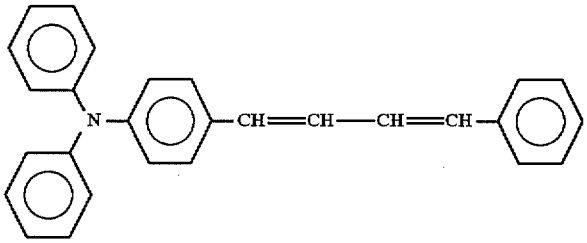

| | |
|---|---|
| Polysulfone (P-1700 manufactured by Nissan Chemical Inc.) | 3 parts |
| 2-Butanone | 150 parts |

Coating Liquid (68):

| | |
|---|---|
| Charge transporting material of the following formula: | 4 parts |

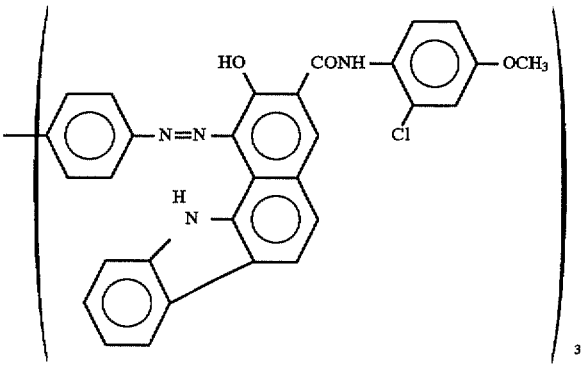

| | |
|---|---|
| Polyvinyl butyral (ESLECK BL-1 manufactured by Sekisui Kagaku Kogyo K.K.) | 4 parts |
| Cyclohexanone | 170 parts |
| Methylcyclohexane | 90 parts |

Comparative Example 10

Example 37 was repeated in the same manner as described except that the intermediate layer was not formed to obtain an electrophotographic photoconductor No. Comp. 10.

The electrophotographic photoconductors Nos. 36 and 37 and Comp. Nos. 9 and 10 were tested for the photoconductive characteristics using a static copying tester (Paper Analyzer Model SP-428 manufactured by Kawaguchi Electro Work Co., Ltd.) in the manner given below.

The photoconductor is subjected to a corona discharge at +5.6 kV or −5.3 kV for 15 seconds. The potential $V_{15}$ (V) is measured 15 seconds after the commencement of the charging. The photoconductor is then dark-decayed and the potential $V_{30}$ (V) thereof is measured after the 15 seconds dark decay. The photoconductor is irradiated with light of a tungsten lamp of 5 lux. The residual potential $V_{50}$ (V) is measured after the 20 seconds exposure. Then, the exposure $E_{1/2}$ (lux·sec) required to reduce the surface potential to a half of $V_{30}$ is measured. The results are shown in Table 9.

TABLE 9

| Photoconductor No. | $V_{15}$ (V) | $V_{30}$ (V) | $E_{1/2}$ (lux · sec) | $V_{50}$ (V) |
|---|---|---|---|---|
| 36 | −1034 | −925 | 1.06 | −2 |
| 37 | −1152 | −947 | * | −479 |
| Comp. 9 | 1294 | 1016 | 1.76 | 3 |
| Comp. 10 | 1375 | 1052 | 5.98 | 182 |

*: Unable to measure because $V_{30}$ was not reduced to a half.

The photoconductors No. 36 and No. Comp. 9 were also tested for the abrasion resistance using Rotary Abrasion Tester (manufactured by Toyo Seiki Seisakusho K. K.) After 1,000 rotation, the photoconductor No. 36 showed a weight loss of 0.02 g, whereas No. Comp. 9 showed a weight loss of 0.13 g.

EXAMPLE 38

On an aluminum-deposited surface of a polyethylene terephthalate film were successively applied and dried a coating liquid (69) for an undercoat layer and a coating liquid (70) for a eutectic complex photoconductive layer having the compositions shown below, thereby obtaining an electrophotographic photoconductor No. 38 having the undercoat layer with a thickness of 1 μm and the photoconductive layer with a thickness of 20 μm.

Coating Liquid (69):

| | |
|---|---|
| Polymeric charge transporting material of the following formula: | 11 parts |

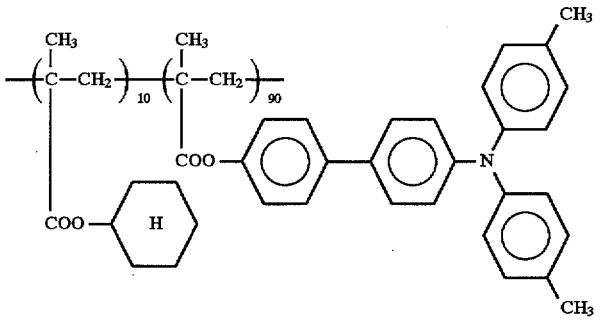

| | |
|---|---|
| Charge transporting material of the following formula: | 8 parts |

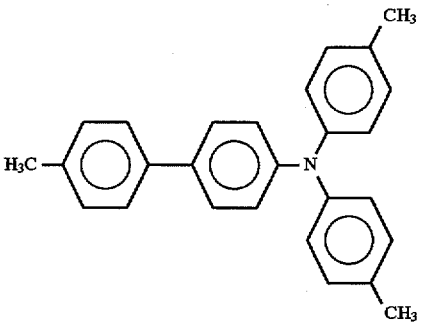

| | |
|---|---|
| 2-Butanone | 50 parts |

Coating Liquid (70):

| | |
|---|---|
| 4-(4-Dimethylaminophenyl)-2,6-diphenyl-thiapyrilium tetrafluoroborate | 1.5 parts |
| Polycarbonate (PANLITE L-1225 manufactured by Teijin Kasei K.K.) | 24 parts |
| Hole transporting material of the following formula: | 20 parts |

-continued

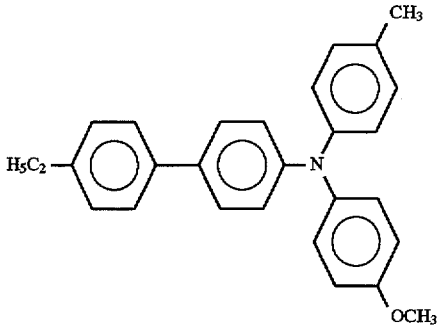

| | |
|---|---|
| Methylene chloride | 620 parts |

Comparative Example 11

Example 38 was repeated in the same manner as described except that a coating liquid (71) was substituted for the coating liquid (69) for the formation of the undercoat layer to obtain an electrophotographic photoconductor No. Comp. 11.

Coating Liquid (71):

| | |
|---|---|
| Water-soluble polyvinyl acetal (W-101 manufactured by Sekisui Kagaku | 15 parts |

-continued

| | |
|---|---|
| Kogyo K. K., 10% aqueous solution) | |
| Water | 20 parts |
| Methanol | 50 parts |

EXAMPLE 39

Over a nickel endless belt with a thickness of 45 μm prepared by electrocasting were successively applied and dried a coating liquid (72) for an undercoat layer, a coating liquid (73) for a charge generation layer and a coating liquid (74) for a charge transport layer having the compositions shown below, thereby obtaining an electrophotographic photoconductor No. 39 having the undercoat layer with a thickness of 0.7 μm, the charge generation layer with a thickness of 0.3 μm and the charge transport layer with a thickness of 18 μm.

Coating Liquid (72):

| | |
|---|---|
| Polymeric charge transporting material of the following formula: | 10 parts |

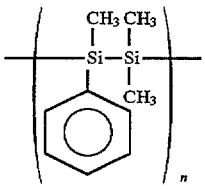

| | |
|---|---|
| Charge transporting material of the following formula: | 5 parts |

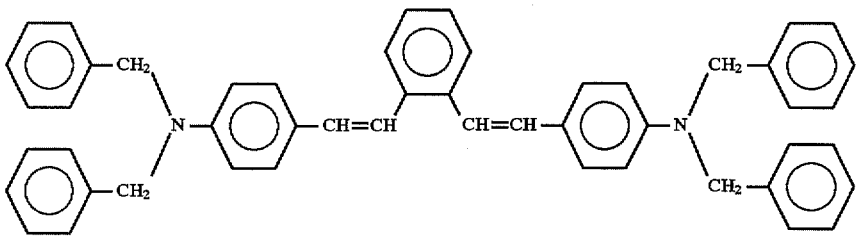

| | |
|---|---|
| Toluene | 50 parts |

Coating Liquid (73)

| | |
|---|---|
| Charge generating material of the following formula: | 5 parts |

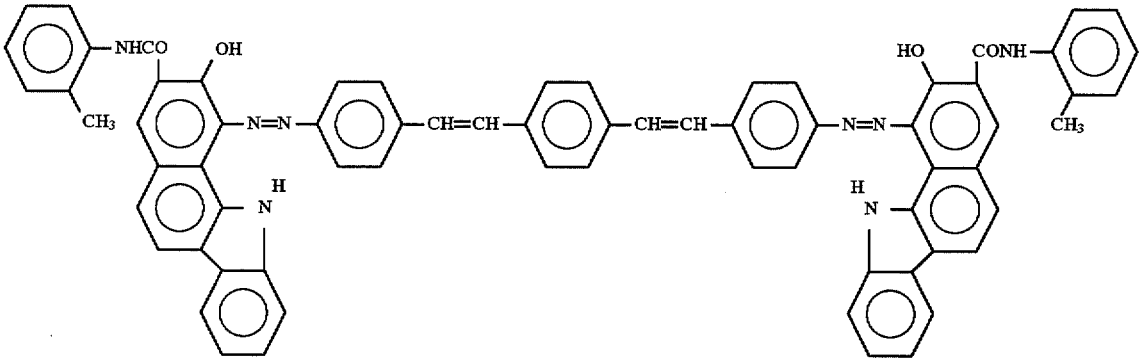

| | |
|---|---|
| Polyvinyl butyral (ESLECK BL-S manufactured by Sekisui Kagaku Kogyo K.K.) | 3 parts |
| Cyclohexanone | 200 parts |
| 4-Methyl-2-pentanone | 90 parts |

Coating Liquid (74):

| | |
|---|---|
| Polycarbonate (PANLITE L-1300 manufactured by Teijin Kasei K.K.) | 11 parts |
| Charge transporting material of the following formula: | 8 parts |

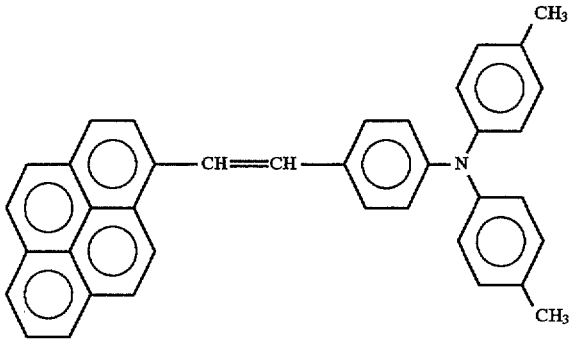

| | |
|---|---|
| Tetrahydrofuran | 80 parts |

for the coating liquid (72) for the formation of the undercoat layer to obtain an electrophotographic photoconductor No. 40.

Coating Liquid (75):

| | |
|---|---|
| Polymeric charge transproting material of the following formula: | 8 parts |

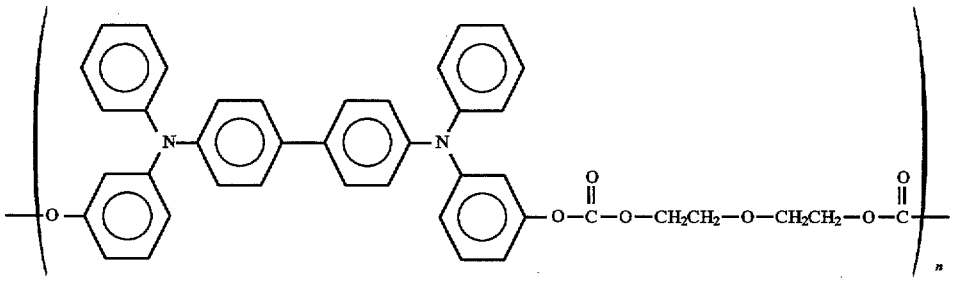

| | |
|---|---|
| Charge transporting material of the following formula: | 7 parts |

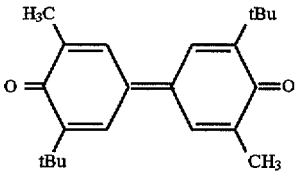

| | |
|---|---|
| Titanium dioxide (TYPAKE R-670 manufactured by Ishihara Sangyo K.K.) | 15 parts |
| Polyvinyl butyral (ESLECK BL-1 manufactured by Sekisui Kagaku Kogyo K.K.) | 2 parts |
| 4-Methyl-2-pentanone | 50 parts |

Comparative Example 12

Example 39 was repeated in the same manner as described except that the undercoat layer was not formed to obtain an electrophotographic photoconductor No. Comp. 12.

EXAMPLE 40

Example 39 was repeated in the same manner as described except that a coating liquid (75) was substituted Comparative Example 13

Example 40 was repeated in the same manner as described except that a coating liquid (76) was substituted for the coating liquid (75) for the formation of the undercoat layer to obtain an electrophotographic photoconductor No. Comp. 13.

Coating Liquid (76):

| | |
|---|---|
| Alcohol-soluble Nylon (AMYLAN CM-8000 manufactured by Toray Inc.) | 7 parts |
| Titanium dioxide (TYPAKE R-670 manufactured by Ishihara Sangyo K. K.) | 15 parts |
| Isopropyl alcohol | 20 parts |
| Methanol | 50 parts |

EXAMPLE 41

On an aluminum plate with a thickness of 0.2 mm were successively applied and dried a coating liquid (77) for an undercoat layer, a coating liquid (78) for a charge transport layer and a coating liquid (79) for a charge generation layer, having the compositions shown below, thereby obtaining an electrophotographic photoconductor No. 41 having the undercoat layer with a thickness of 2.5 μm, the charge transport layer with a thickness of 21 μm and the charge generation layer with a thickness of 0.3 μm.

Coating Liquid (77):

| | |
|---|---|
| Polymeric charge generating material of the following formula: | 10 parts |

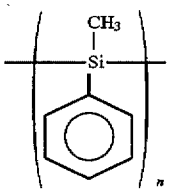

| | |
|---|---|
| Charge transporting material of the following formula: | 9 parts |

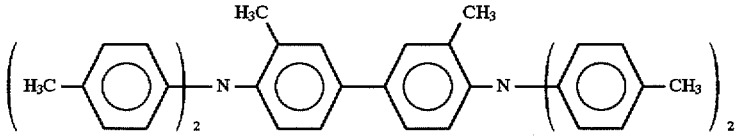

| | |
|---|---|
| Tetrahydrofuran | 50 parts |

Coating Liquid (78):

| | |
|---|---|
| Polycarbonate (PANLITE L-1250 manufactured by Teijin Kasei K.K.) | 8 parts |
| Charge transporting material of the following formula: | 8 parts |

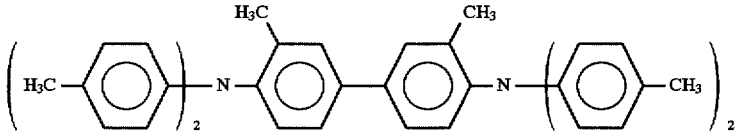

| | |
|---|---|
| Methylene chloride | 80 parts |

Coating Liquid (79):

| | |
|---|---|
| Charge generating material of the following formula: | 5 parts |

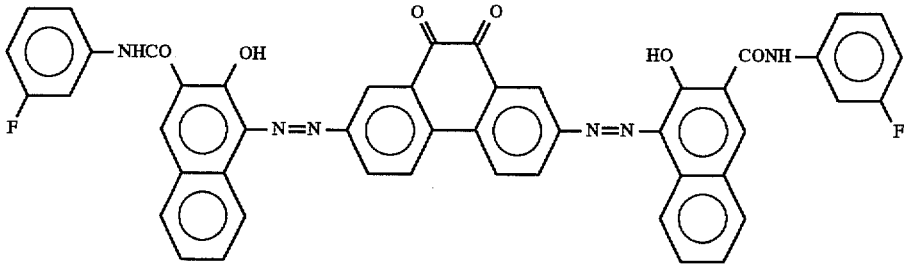

| | |
|---|---|
| Polyvinyl butyral (DENKABUTYRAL #5000-1 manufactured by Denki Kagaku Kogyo K.K.) | 3 parts |
| Tetrahydrofuran | 200 parts |
| 4-Methyl-2-pentanone | 90 parts |

Comparative Example 14

Example 41 was repeated in the same manner as described except that a coating liquid (80) was substituted for the coating liquid (77) for the formation of the undercoat layer to obtain an electrophotographic photoconductor No. Comp. 14.

Coating Liquid (80):

| | |
|---|---|
| Vinyl chloride-vinyl acetate-maleic anhydride copolymer resin (ESLEC MF-10 manufactured by Sekisui Kakagu Kogyo K. K.) | 15 parts |
| Isopropyl alcohol | 20 parts |
| Methanol | 50 parts |

EXAMPLE 42

Example 41 was repeated in the same manner as described except that a coating liquid (81) was substituted for the coating liquid (77) for the formation of the undercoat layer to obtain an electrophotographic photoconductor No. 42.

Coating Liquid (81):

| | |
|---|---|
| Polymeric charge generating material of the following formula: | 10 parts |

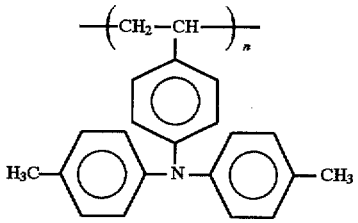

| | |
|---|---|
| Charge transporting material of the following formula: | 5 parts |

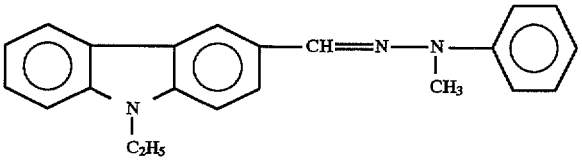

| | |
|---|---|
| Aluminum oxide powder | 30 parts |
| 4-Methyl-2-pentanone | 50 parts |

Comparative Example 15

Example 42 was repeated in the same manner as described except that a coating liquid (82) was substituted for the coating liquid (81) for the formation of the undercoat layer to obtain an electrophotographic photoconductor No. Comp. 15.

Coating Liquid (82):

| | |
|---|---|
| Polyacrylate (U POLYMER U-100 manufactured by Unichika Inc.) | 15 parts |
| Tetrahydrofuran | 20 parts |
| 2-Butanone | 50 parts |

EXAMPLE 43

On an aluminum-deposited surface of a polyethylene terephthalate film were successively applied and dried a coating liquid (83) for an undercoat layer and a coating liquid (84) for a photoconductive layer having the compositions shown below, thereby obtaining an electrophotographic photoconductor No. 43 having the undercoat layer with a thickness of 2 μm and the photoconductive layer with a thickness of 19 μm.

Coating Liquid (83):

| | |
|---|---|
| Polymeric charge transporting material of the following formula: | 10 parts |

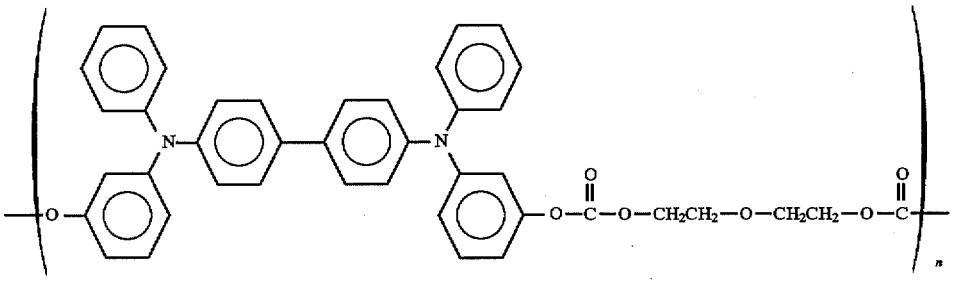

| | |
|---|---|
| 2-Butanone | 50 parts |

Coating Liquid (84):

| | |
|---|---|
| Charge generating material of the following formula: | 1.5 parts |

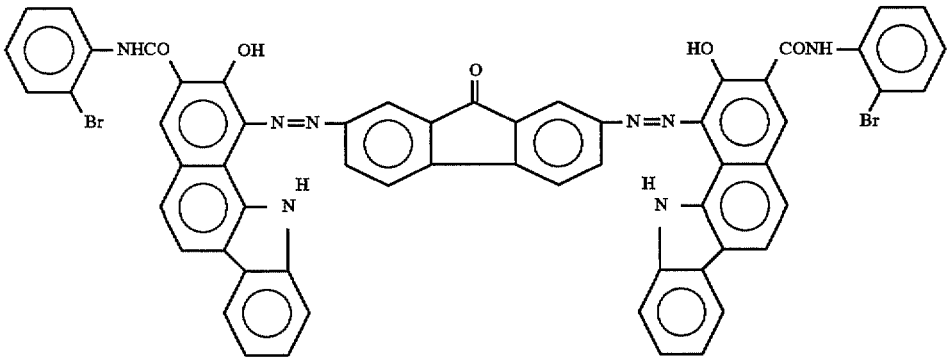

| | |
|---|---|
| Polymeric charge transporting material of the following formula: | 24 parts |

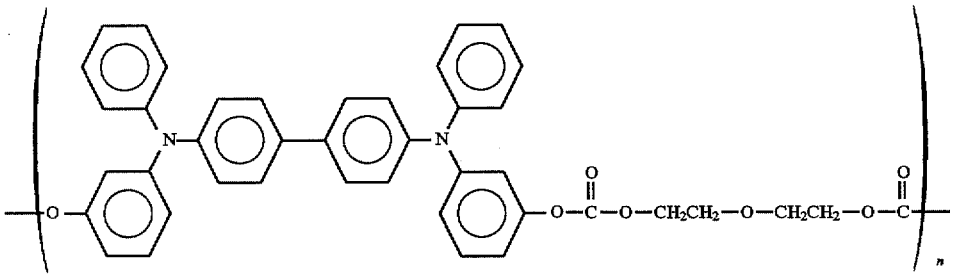

| | |
|---|---|
| Tetrahydrofuran | 650 parts |

Comparative Example 16

Example 43 was repeated in the same manner as described except that a coating liquid (85) was substituted for the coating liquid (83) for the formation of the undercoat layer to obtain an electrophotographic photoconductor No. Comp. 16.

Coating Liquid (85):

| | |
|---|---|
| Water-soluble polyvinyl acetal (W-101 manufactured by Sekisui Kagaku Kogyo K. K., 25% aqueous solution) | 10 parts |
| Water | 30 parts |
| Methanol | 30 parts |

EXAMPLE 44

Over a nickel endless belt with a thickness of 50 μm prepared by electrocasting were successively applied and dried a coating liquid (86) for an undercoat layer, a coating liquid (87) for a charge generation layer and a coating liquid (88) for a charge transport layer having the compositions shown below, thereby obtaining an electrophotographic photoconductor No. 44 having the undercoat layer with a thickness of 0.5 μm, the charge generation layer with a thickness of 0.2 μm and the charge transport layer with a thickness of 23 μm.

Coating Liquid (86):

| | |
|---|---|
| Polymeric charge transporting material of the following formula: | 10 parts |

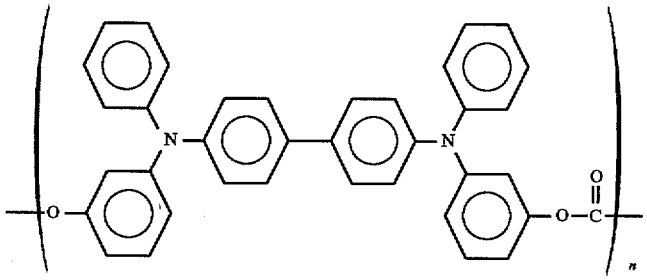

| | |
|---|---|
| Toluene | 50 parts |

Coating Liquid (87)

| | |
|---|---|
| Charge generating material of the following formula: | 5 parts |

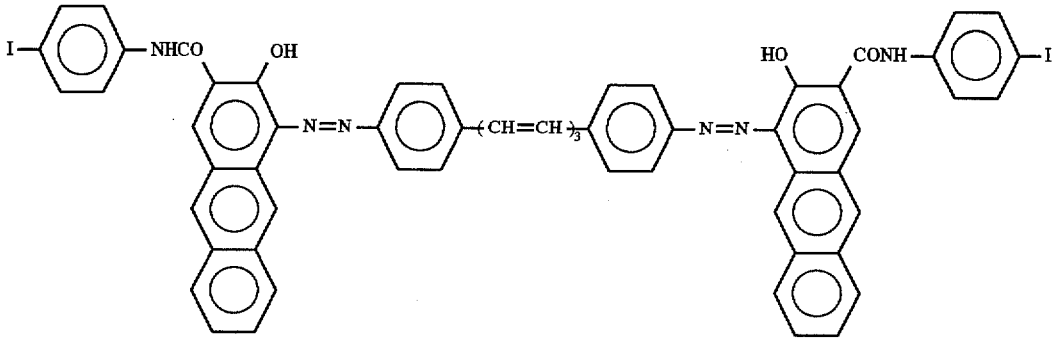

| | |
|---|---|
| Polymeric charge transporting material of the following formula: | 4 parts |

-continued

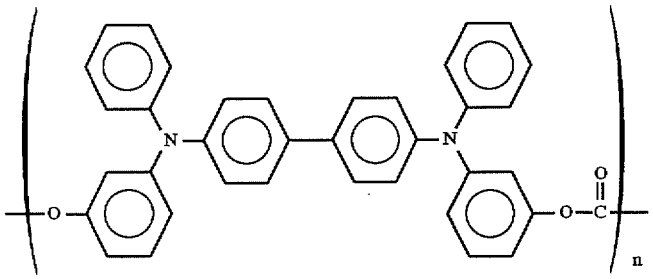

| | |
|---|---|
| Cyclohexanone | 200 parts |
| 4-Methyl-2-pentanone | 90 parts |

Coating Liquid (88):

| | |
|---|---|
| Polycarbonate (YUPILON Z-300 manufactured by Mitsubishi Gas Chemical Inc.) | 11 parts |
| Charge transporting material of the following formula: | 8 parts |

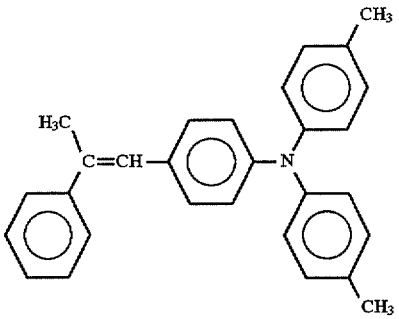

| | |
|---|---|
| Tetrahydrofuran | 80 parts |

EXAMPLE 45

Example 44 was repeated in the same manner as described except that a coating liquid (89) was substituted for the coating liquid (87) for the formation of the charge generating layer to obtain an electrophotographic photoconductor No. 45.

Coating Liquid (89)

| | |
|---|---|
| Charge generating material of the following formula: | 5 parts |

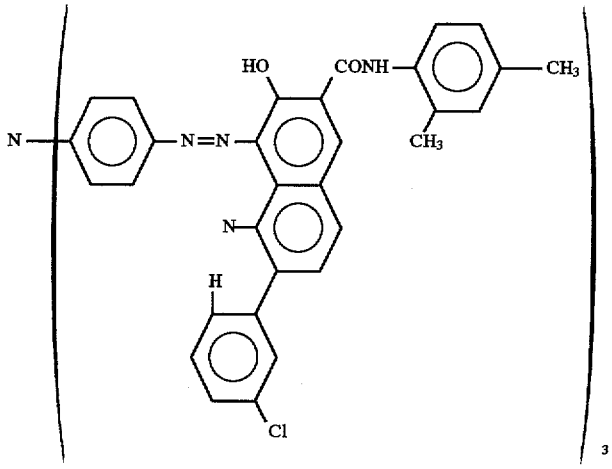

| | |
|---|---|
| Polymeric charge transporting material of the following formula: | 2 parts |

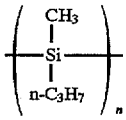

| | |
|---|---|
| Polyester (BYLON 300 manufactured by Toyo Boseki K. K.) | 1 part |
| Cyclohexanone | 200 parts |
| Tetrahydrofuran | 90 parts |

EXAMPLE 46

Over an outer surface of an aluminum cylindrical support having an outer diameter of 80 mm were successively applied and dried a coating liquid (90) for an undercoat layer, a coating liquid (91) for a charge transport layer, a coating liquid (92) for a charge generation layer and a coating liquid (93) for a protecting layer, having the compositions shown below, thereby obtaining an electrophotographic photoconductor No. 46 having the undercoat layer with a thickness of 3 μm, the charge transport layer with a thickness of 23 μm, the charge generation layer with a thickness of 0.4 μm and the protecting layer with a thickness of 5 μm.

Coating Liquid (90):

| | |
|---|---|
| Polymeric charge generating material of the following formula: | 10 parts |

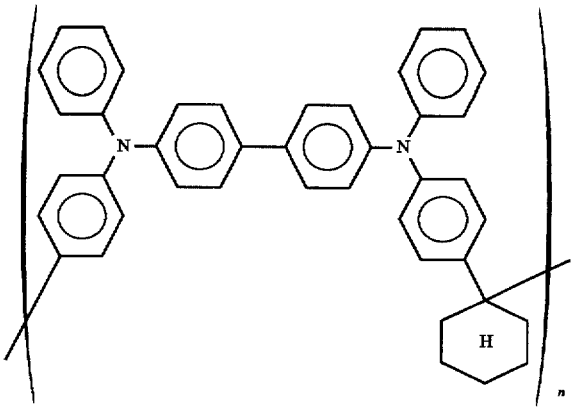

-continued

| | |
|---|---|
| Methyl chloride | 50 parts |

Coating Liquid (91):

| | |
|---|---|
| Polymeric charge transporting material of the following formula: | 10 parts |

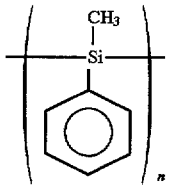

| | |
|---|---|
| Tetrahydrofuran | 80 parts |

Coating Liquid (92):

| | |
|---|---|
| x-Type non-metallic phthalocyanine | 5 parts |
| Polyviny butyral (DENKABUTYRAL #5000-1 manufactured by Denki Kagaku Kogyo K. K.) | 3 parts |
| Tetrahydrofuran | 200 parts |
| 4-Methyl-2-pentanone | 90 parts |

Coating Liquid (93):

| | |
|---|---|
| Tin oxide containing 10% antimony oxide | 30 parts |
| Styrene-methacrylic acid-N-methylol | 10 parts |

-continued

| | |
|---|---|
| methacrylamide resin | |
| Toluene | 80 parts |
| n-Butanol | 70 parts |

EXAMPLE 47

Example 46 was repeated in the same manner as described except that a coating liquid (94) was substituted for the coating liquid (90) for the formation of the undercoat layer to obtain an electrophotographic photoconductor No. 47.

Coating Liquid (94):

| | |
|---|---|
| Polymeric charge generating material of the following formula: | 10 parts |

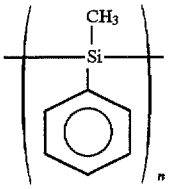

| | |
|---|---|
| Aluminum oxide powder | 30 parts |
| 4-Methyl-2-pentanone | 50 parts |

The electrophotographic photoconductors Nos. 38–47 and Comp. Nos. 11–16 were tested for the photoconductive characteristics using a static copying tester (Paper Analyzer Model SP-428 manufactured by Kawaguchi Electro Work Co., Ltd.) in the manner given below.

The photoconductor is subjected to a corona discharge at +6.0 kV or −5.5 kV for 20 seconds. The potential $V_m$ (V) is measured 20 seconds after the commencement of the charging. The photoconductor is then dark-decayed and the potential $V_0$ (V) thereof is measured after the 20 seconds dark decay. The photoconductor is irradiated with light of a tungsten lamp of 6 lux. The residual potential $V_R$ (V) is measured after the 20 seconds exposure. Then, the exposure $E_{1/2}$ (lux·sec) required to reduce the surface potential to a half of $V_0$ is measured. The photoconductor is thereafter subjected simultaneously to the corona discharge and exposure treatments for 1 hour. After the fatigue treatment, the photoconductor is tested for the characteristics thereof in the same manner as above. The results are shown in Table 10. In Table 10, $V_0/V_m$ represents a potential retentivity.

TABLE 10

| | Initial | | | After Fatigue | | |
|---|---|---|---|---|---|---|
| Photoconductor No. | $V_0/V_m$ | $E_{1/2}$ (lux · sec) | $V_R$ (V) | $V_0/V_m$ | $E_{1/2}$ (lux · sec) | $V_R$ (V) |
| 38 | 0.82 | 1.08 | 0 | 0.80 | 0.98 | 1 |
| Comp. 11 | 0.86 | 1.12 | 7 | 0.84 | 1.40 | 39 |

TABLE 10-continued

| | Initial | | | After Fatigue | | |
|---|---|---|---|---|---|---|
| Photoconductor No. | $V_0/V_m$ | $E_{1/2}$ (lux · sec) | $V_R$ (V) | $V_0/V_m$ | $E_{1/2}$ (lux · sec) | $V_R$ (V) |
| 39 | 0.85 | 0.67 | 0 | 0.83 | 0.65 | 0 |
| Comp. 12 | 0.87 | 0.63 | −3 | 0.45 | 0.78 | −8 |
| 40 | 0.82 | 0.60 | −1 | 0.80 | 0.59 | −1 |
| Comp. 13 | 0.76 | 0.63 | 0 | 0.32 | 0.81 | −14 |
| 41 | 0.84 | 0.82 | 0 | 0.80 | 0.79 | 0 |
| Comp. 14 | 0.83 | 0.82 | 3 | 0.76 | 0.84 | 35 |
| 42 | 0.86 | 0.64 | 0 | 0.83 | 0.62 | 1 |
| Comp. 15 | 0.89 | 1.24 | 10 | 0.86 | 2.25 | 141 |
| 43 | 0.84 | 1.25 | 1 | 0.81 | 1.32 | 2 |
| Comp. 16 | 0.80 | 1.27 | 6 | 0.50 | 1.39 | 36 |
| 44 | 0.83 | 0.72 | 0 | 0.81 | 0.71 | −1 |
| 45 | 0.84 | 0.66 | 0 | 0.83 | 0.61 | 0 |
| 46 | 0.82 | 0.79 | 0 | 0.81 | 0.81 | 1 |
| 47 | 0.81 | 0.80 | 0 | 0.78 | 0.81 | 0 |

The photoconductors Nos. 38–47 were each mounted on a laser printer (SP2000 manufactured by Ricoh Company Ltd.) and prints were produced. Clear images were found to be obtained. The photoconductor No. 40 gave especially excellent images free of moire. Each of the photoconductors Nos. 38–47 and Comp. 11–16 was subjected repeated printing test. Upon 1,000 printing operations, the photoconductors Nos. Comp. 11–16 caused separation of the photoconducting layer from the conductive support. No such separation was caused in the case of the photoconductors Nos. 38–47.

EXAMPLE 48

Over an outer surface of an aluminum cylindrical support having an outer diameter of 80 mm were successively applied and dried a coating liquid (95) for an undercoat layer and a coating liquid (96) for a charge generating layer, having the compositions shown below, to form the undercoat layer with a thickness of 0.3 μm and the charge generation layer with a thickness of 0.3 μm. Thereafter, a coating liquid (97) and a coating liquid (98) having the compositions shown below were successively applied by spraying on the charge generation layer and then dried to form a charge transport layer with a thickness of 21 μm on the charge generation layer, thereby obtaining an electrophotographic photoconductor No. 48.

Coating Liquid (95):

| | |
|---|---|
| Water-soluble polyvinyl acetal (W-101 manufactured by Sekisui Kagaku Kogyo K. K.) | 10 parts |
| Water | 20 parts |
| Methanol | 30 part5 |

Coating Liquid (96):

| | |
|---|---|
| Charge generating material of the following formula: | 4 parts |

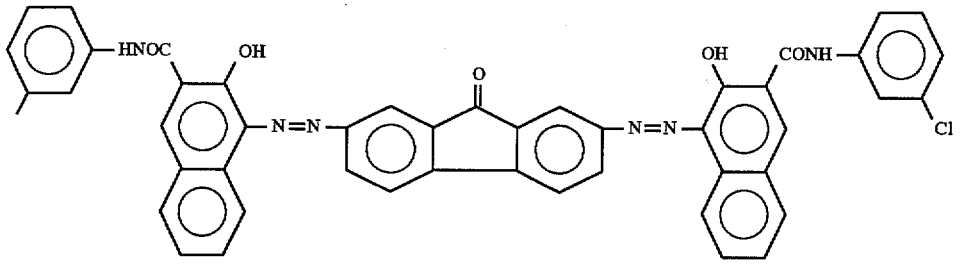

| | |
|---|---|
| Polyvinyl butyral (ESLECK BL-S manufactured by Sekisui Kagaku Kogyo K. K.) | 1 part |
| Tetrahydrofuran | 200 parts |
| Cyclohexanone | 50 parts |

Coating Liquid (97):

| | |
|---|---|
| Charge transporting material of the following formula: | 10 parts |

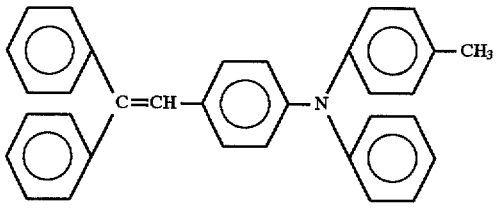

| | |
|---|---|
| Polymeric charge generating material of the following formula: | 20 parts |

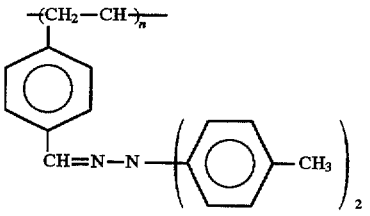

| | |
|---|---|
| Tetrahydrofuran | 350 parts |

Coating Liquid (98):

| | |
|---|---|
| Polymeric charge generating material of the following formula: | 10 parts |

-continued

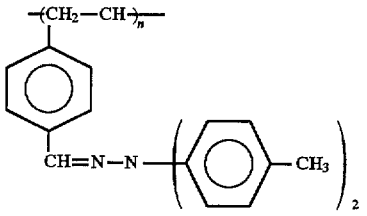

| | |
|---|---|
| Tetrahydrofuran | 200 parts |

EXAMPLE 49

Over an outer surface of an aluminum cylindrical support having an outer diameter of 80 mm were successively applied and dried a coating liquid (99) for a charge generating layer, having the compositions shown below, to form the charge generation layer with a thickness of 0.2 μm. Thereafter, three kinds of coating liquids (100)–(102) having the compositions shown below were successively applied on the charge generation layer by spraying and then dried to form a charge transport layer with a thickness of 25 μm on the charge generation layer, thereby obtaining an electrophotographic photoconductor No. 49.

Coating Liquid (99):

| | |
|---|---|
| Charge generating material of the following formula: | 10 parts |

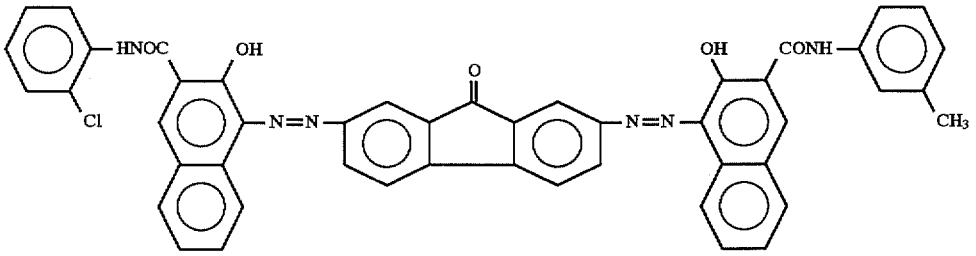

| | |
|---|---|
| Polyvinyl ether (LUTONAL-A manufactured by BASF) | 4 parts |
| Tetrahydrofuran | 300 parts |
| Cyclohexanone | 300 parts |

Coating Liquid (100):

| | |
|---|---|
| Charge transporting material of the following formula: | 30 parts |

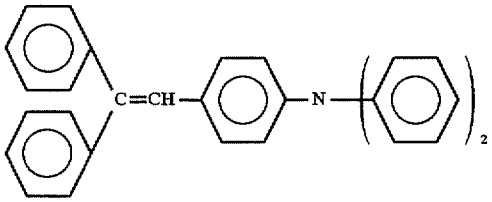

| | |
|---|---|
| Tetrahydrofuran | 200 parts |

Coating Liquid (101):

| | |
|---|---|
| Charge transporting material of the following formula: | 10 parts |

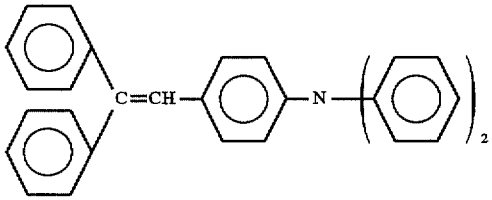

| | |
|---|---|
| Polymeric charge generating material of the following formula: | 10 parts |

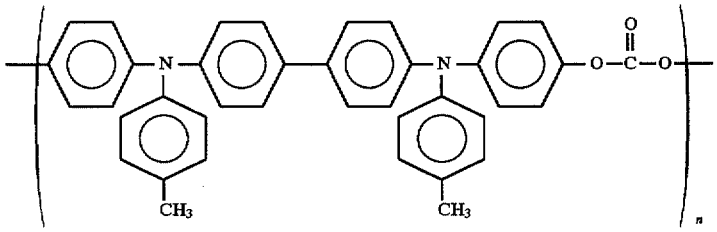

| | |
|---|---|
| Tetrahydrofuran | 300 parts |

Coating Liquid (102):

Polymeric charge generating material of the following formula: 10 parts

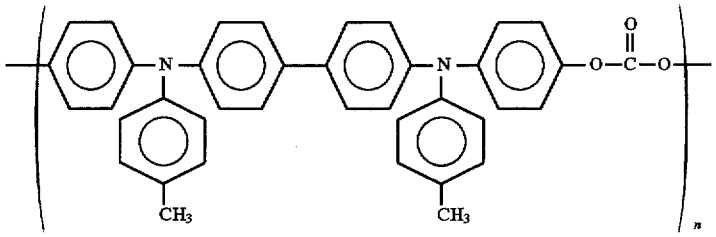

Tetrahydrofuran 300 parts

EXAMPLE 50

Example 48 was repeated in the same manner as described except that a coating liquid (103) was substituted for the coating liquid (98) for the formation of the charge transport layer to obtain an electrophotographic photoconductor No. 50.

Coating Liquid (103):

Charge transporting material of the following formula: 2 parts

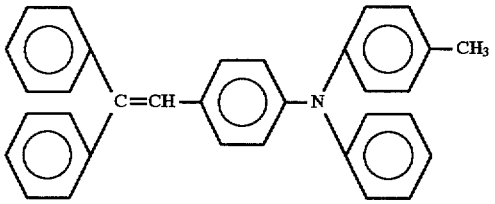

Polymeric charge generating material of the following formula: 18 parts

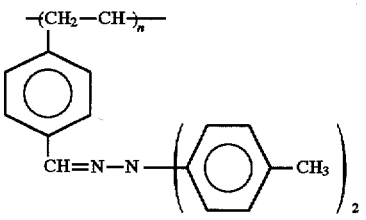

Tetrahydrofuran 150 parts

EXAMPLE 51

Example 48 was repeated in the same manner as described except that a coating liquid (104) was substituted for the coating liquid (98) for the formation of the charge transport layer to obtain an electrophotographic photoconductor No. 51.

Coating Liquid (104):

Charge transporting material of the following formula: 5 parts

-continued

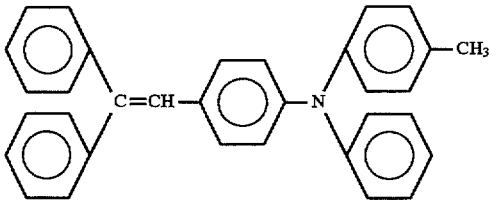

Polymeric charge generating material of the following formula: 20 parts

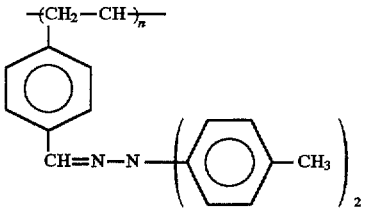

Tetrahydrofuran 350 parts

EXAMPLE 52

Example 48 was repeated in the same manner as described except that a coating liquid (105) was substituted for the coating liquid (97) for the formation of the charge transport layer to obtain an electrophotographic photoconductor No. 52.

Coating Liquid (105):

Polymeric charge generating material of the following formula: 20 parts

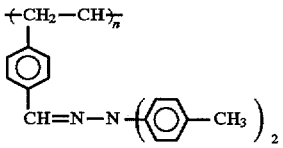

-continued

| | |
|---|---|
| Charge transporting material of the following formula: | 5 parts |
| 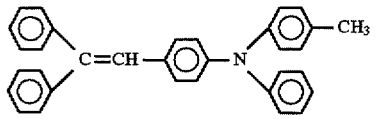 | |
| Tetrahydrofuran | 200 parts |

EXAMPLE 53

Example 48 was repeated in the same manner as described except that a coating liquid (106) was substituted for the coating liquid (97) for the formation of the charge transport layer to obtain an electrophotographic photoconductor No. 53.

Coating Liquid (106)

| | |
|---|---|
| Charge transporting material of the following formula: | 2 parts |
| 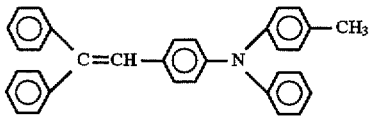 | |
| Polymeric charge generating material of the following formula: | 18 parts |
| 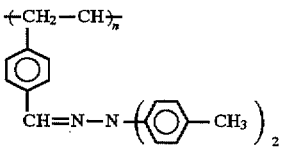 | |
| Tetrahydrofuran | 400 parts |

EXAMPLE 54

Over an outer surface of an aluminum cylindrical support having an outer diameter of 80 mm were successively applied and dried a coating liquid (107) for an undercoat layer, a coating liquid (108) for a charge generating layer, coating liquids (109) and (110) for first and second charge transport layers, respectively, having the compositions shown below, were successively applied and dried to form an electrophotographic photoconductor No. 54 having the undercoat layer with a thickness of 0.3 μm, the charge generation layer with a thickness of 0.2 μm, the first charge transport layer with a thickness of 20 μm and the second charge transport layer with a thickness of 2 μm.

Coating Liquid (107):

| | |
|---|---|
| Polyvinyl alcohol (KURARAY POVAL PVA-110 manufactured by Kuraray Inc.) | 3 parts |
| Methanol | 50 parts |
| Water | 50 parts |

Coating Liquid (108):

| | |
|---|---|
| Charge generating material of the following formula: | 3 parts |
| 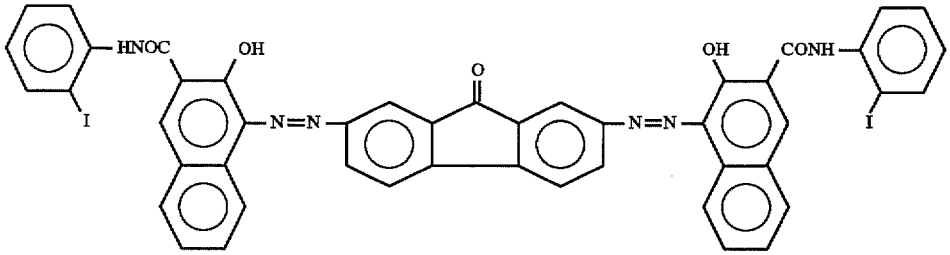 | |
| Cyclohexanone | 70 parts |
| 4-Methyl-2-pentanone | 30 parts |

Coating Liquid (109):

| | |
|---|---|
| Charge transporting material of the following formula: | 10 parts |
| 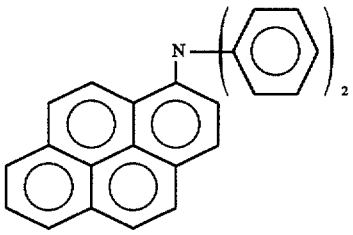 | |
| Polycarbonate (PAN LITE K-1300 manufactured by Teijin Kasei K. K.) | 10 parts |
| Tetrahydrofuran | 150 parts |

Coating Liquid (110):

| | |
|---|---|
| Polymeric charge generating material of the following formula: | 10 parts |

-continued

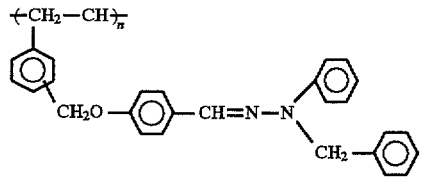

| | |
|---|---|
| Methylene chloride | 90 parts |

-continued

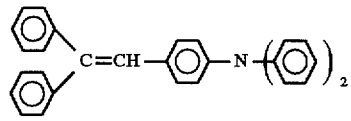

| | |
|---|---|
| Polycarbonate (YUPILON Z-300 manufactured by Mitsubishi Gas Chemical Inc.) | 10 parts |
| Tetrahydrofuran | 100 parts |

EXAMPLE 55

Over an outer surface of an aluminum cylindrical support having an outer diameter of 80 mm were successively applied and dried a coating liquid (111) for a charge generating layer, a coating liquid (112) for a first charge transport layer, a coating liquid (113) for a second charge transport layer and a coating liquid (114) for a third charge transport layer, having the compositions shown below, were successively applied and dried to form an electrophotographic photoconductor No. 55 having the charge generation layer with a thickness of 0.2 μm, the first charge transport layer with a thickness of 1 μm, the second charge transport layer with a thickness of 20 μm and the third charge transport layer with a thickness of 3 μm.

Coating Liquid (111):

| | |
|---|---|
| Charge generating material of the following formula: | 10 parts |

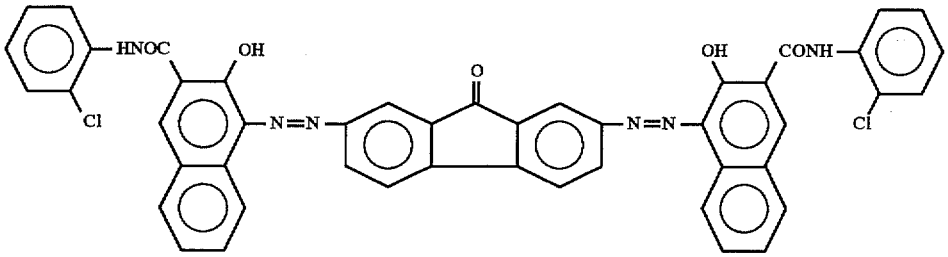

| | |
|---|---|
| Polyvinyl ether (LUTANOL-A manufactured by BASF) | 4 parts |
| Tetrahydrofuran | 300 parts |
| Cyclohexanone | 300 parts |

Coating Liquid (112):

| | |
|---|---|
| Charge transporting material of the following formula: | 30 parts |

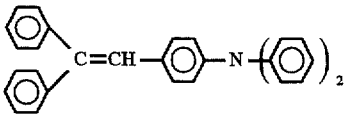

| | |
|---|---|
| Polycarbonate (YUPILON Z-300 manufactured by Mitsubishi Gas CHemical Inc.) | 10 parts |
| Tetrahydrofuran | 200 parts |

Coating Liquid (113):

| | |
|---|---|
| Charge transporting material of the following formula: | 10 parts |

Coating Liquid (114):

| | |
|---|---|
| Polymeric charge generating material of the following formula: | 10 parts |

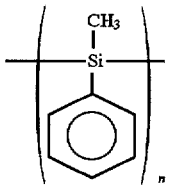

| | |
|---|---|
| Methyl chloride | 100 parts |

EXAMPLE 56

Example 55 was repeated in the same manner as described except that a coating liquid (115) was substituted for the coating liquid (112) for the formation of the first charge transport layer to obtain an electrophotographic photoconductor No. 56.

Coating Liquid (115):

| | |
|---|---|
| Charge transporting material of the following formula: | 5 parts |

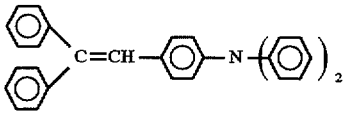

| | |
|---|---|
| Tetrahydrofuran | 150 parts |

EXAMPLE 57

Example 54 was repeated in the same manner as described except that a coating liquid (116) was substituted for the coating liquid (110) for the formation of the second charge transport layer to obtain an electrophotographic photoconductor No. 57.

Coating Liquid (116):

| | |
|---|---|
| Charge transporting material of the following formula: | 10 parts |

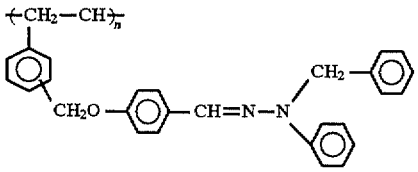

| | |
|---|---|
| Polycarbonate (YUPILON Z-300 manufactured by Mitsubishi Gas Chemical Inc.) | 3 parts |
| Methylene chloride | 120 parts |

EXAMPLE 58

Example 54 was repeated in the same manner as described except that a coating liquid (117) was substituted for the coating liquid (109) for the formation of the first charge transport layer to obtain an electrophotographic photoconductor No. 58.

Coating Liquid (117):

| | |
|---|---|
| Polymeric charge transporting material of the following formula: | 20 parts |

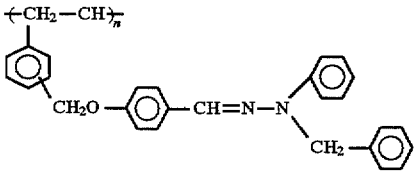

| | |
|---|---|
| Charge transporting material of the following formula: | 5 parts |

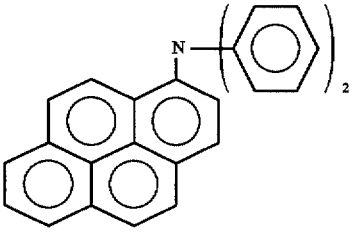

| | |
|---|---|
| Tetrahydrofuran | 200 parts |

Comparative Example 17

Example 48 was repeated in the same manner as described except that the coating liquid (98) was used by itself for the formation of the charge transport layer, thereby to obtain an electrophotographic photoconductor No. Comp. 17.

Comparative Example 18

Example 49 was repeated in the same manner as described except that the coating liquid (102) was used by itself for the formation of the charge transport layer, thereby to obtain an electrophotographic photoconductor No. Comp. 18.

Comparative Example 19

Example 48 was repeated in the same manner as described except that a coating liquid (98a) was substituted for the coating liquid (98) for the formation of the charge transport layer to obtain an electrophotographic photoconductor No. Comp. 19.

Coating Liquid (98a):

| | |
|---|---|
| Polycarbonate (A2700 manufactured by Idemitsu Petrochemical Inc.) | 10 parts |
| Tetrahydrofuran | 200 parts |

Comparative Example 20

Example 48 was repeated in the same manner as described except that the coating liquid (118) having the composition shown below was used by itself for the formation of the charge transport layer, thereby to obtain an electrophotographic photoconductor No. Comp. 20.

Coating Liquid (118):

| | |
|---|---|
| Charge transporting material of the following formula: | 10 parts |

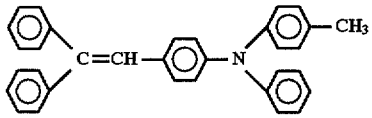

| | |
|---|---|
| Polycarbonate (A2700 manufactured by Idemitsu Petrochemical Inc.) | 10 parts |
| Tetrahydrofuran | 200 parts |

Comparative Example 21

Example 54 was repeated in the same manner as described except that the coating liquid (109) was used by itself for the formation of the charge transport layer, thereby to obtain an electrophotographic photoconductor No. Comp. 21.

Comparative Example 22

Example 54 was repeated in the same manner as described except that the coating liquid (110) was used by itself for the formation of the charge transport layer, thereby to obtain an electrophotographic photoconductor No. Comp. 22.

The electrophotographic photoconductors Nos. 48–58 and Comp. 17–22 were tested for their photoconductive characteristics using a device disclosed in JP-A-60-100167 in the manner given below.

The photoconductor is subjected to a corona discharge at −6.5 kV for 15 seconds and then dark-decayed. When a surface potential of −800 V is reached, the photoconductor is irradiated with light of a tungsten lamp of 6 lux. The, the exposure $E_{400}$ (lux·sec) required to reduce the surface potential to −400 V is measured. Further, the surface potential $V_{20}$ (V) after 20 seconds irradiation with the tungsten lamp is measured. The photoconductor is thereafter subjected simultaneously to the corona discharge and exposure treatments for 1 hour. After the fatigue treatment, the photoconductor is tested for the characteristics thereof in the same manner as above. The results are shown in Table 11.

The photoconductors Nos. 48, 50, 51, 54 and 57 and Comp. 17 and Comp. 20 were tested for an image reproduction test as follows: The photoconductor is mounted on electrophotographic apparatus RICOPY 5510 (arranged to be negatively charged) manufactured by Ricoh Company Ltd. The apparatus is allowed to continuously run for obtaining 100,000 copies. The reproduced images obtained at 10 and 100,000 copying operation are evaluated. The amount of decrease of the thickness of the charge transport layer caused by the running test is also measured. The results are summarized in Table 12.

TABLE 11

| Photoconductor No. | Initial $E_{400}$ (lux · sec) | Initial $V_{20}$ (−V) | After Fatigue $E_{400}$ (lux · sec) | After Fatigue $V_{20}$ (−V) |
|---|---|---|---|---|
| 48 | 0.76 | 1 | 0.78 | 5 |
| 49 | 0.63 | 0 | 0.66 | 4 |
| 50 | 0.74 | 0 | 0.76 | 2 |
| 51 | 0.72 | 0 | 0.73 | 1 |
| 52 | 0.80 | 2 | 0.83 | 10 |
| 53 | 0.88 | 5 | 0.99 | 20 |
| 54 | 1.13 | 0 | 1.15 | 2 |
| 55 | 0.92 | 0 | 0.93 | 3 |
| 56 | 0.88 | 0 | 0.89 | 1 |

TABLE 11-continued

| Photoconductor No. | Initial $E_{400}$ (lux · sec) | Initial $V_{20}$ (−V) | After Fatigue $E_{400}$ (lux · sec) | After Fatigue $V_{20}$ (−V) |
|---|---|---|---|---|
| 57 | 1.15 | 0 | 1.16 | 5 |
| 58 | 1.05 | 0 | 1.05 | 0 |
| Comp. 17 | 1.33 | 10 | 2.16 | 35 |
| Comp. 18 | 1.58 | 13 | 2.33 | 42 |
| Comp. 19 | 2.18 | 23 | 4.16 | 76 |
| Comp. 20 | 0.70 | 0 | 0.72 | 1 |
| Comp. 21 | 1.08 | 0 | 1.15 | 4 |
| Comp. 22 | 1.95 | 10 | 3.88 | 40 |

TABLE 12

| Photoconductor No. | 10th copy | $10^5$th copy | Decreased Amount |
|---|---|---|---|
| 48 | good | good | 0.5 μm |
| 50 | good | good | 0.5 μm |
| 51 | good | good | 1.5 μm |
| 54 | good | good | 1.2 μm |
| 57 | good | good | 0.7 μm |
| Comp. 17 | good | * | 3.0 μm |
| Comp. 20 | good | * | 5.5 μm |

*Abnormal image due to abrasion of photoconductor is found (fouling of background and formation of streaks).

EXAMPLE 59

Over an outer surface of an aluminum cylindrical support having an outer diameter of 80 mm were successively applied and dried a coating liquid (119) for a charge generating layer, a coating liquid (120) for a charge transport layer, a coating liquid (121) for an intermediate layer and a coating liquid (122) for a protecting layer, having the compositions shown below, to form an electrophotographic photoconductor No. 59 having the charge generation layer with a thickness of 0.2 μm, the charge transport layer with a thickness of 20 μm, the intermediate layer with a thickness of 0.2 μm and the protecting layer with a thickness of 3 μm, thereby obtaining an electrophotographic photoconductor No. 59.

Coating Liquid (119):

Charge generating material of the following formula: 7 parts

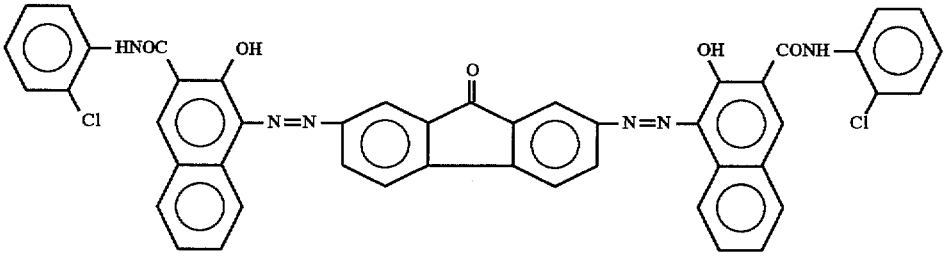

Polyvinyl butyral (XYHL manufactured by Union Carbide Corporation) 2 parts
Cyclohexanone 200 parts
Tetrahydrofuran 100 parts Coating Liquid (120):

Charge transporting material of the following formula: 7 parts

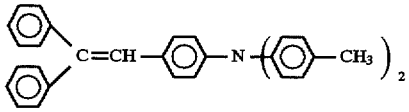

Polycarbonate (YUPILON S-2000 manufactured by Misubishi Gas Chemical Inc.) 10 parts
Methylene chloride 100 parts Coating Liquid (121):

| | |
|---|---|
| Alcohol-soluble Nylon (AMYLAN CM-4000 manufactured by Toray Inc.) | 3 parts |
| Methanol | 60 parts |
| Butanol | 40 parts |

Coating Liquid (122):

| | |
|---|---|
| Polyacrylate (U POLYMER U-100 manufactured by Unichika Inc.) | 10 parts |
| Polymeric charge transporting material of the following formula: | 5 parts |

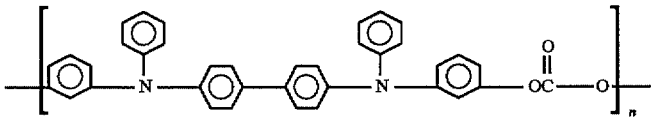

| | |
|---|---|
| Tetrahydrofuran | 150 parts |

EXAMPLE 60

Example 59 was repeated in the same manner as described except that a coating liquid (123) having the composition shown below was substituted for the coating liquid (122) for the formation of the protecting layer, thereby to obtain an electrophotographic photoconductor No. 60.

Coating Liquid (123):

| | |
|---|---|
| Polyacrylate (U POLYMER U-100 manufactured by Unichika Inc.) | 10 parts |
| Polymeric charge transporting material of the following formula: | 5 parts |

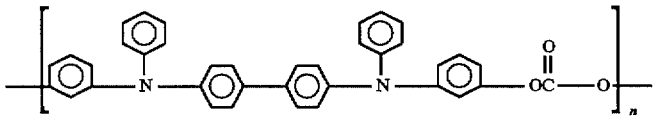

| | |
|---|---|
| Tin oxide | 5 parts |
| Tetrahydrofuran | 150 parts |

EXAMPLE 61

Example 59 was repeated in the same manner as described except that a coating liquid (124) having the composition shown below was substituted for the coating liquid (122) for the formation of the protecting layer, thereby to obtain an electrophotographic photoconductor No. 61.

Coating Liquid (124):

| | |
|---|---|
| Styrene-methylmethacrylate-2-hydroxymethyl-methacrylate copolymer | 10 parts |
| Polymeric charge transporting material of the following formula: | 5 parts |

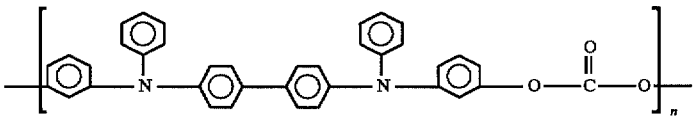

| | |
|---|---|
| Tin oxide | 5 parts |
| Hexamethylenediisocyanate | 0.5 part |
| Methyl isobutyl ketone | 50 parts |
| Tetrahydrofuran | 100 parts |

EXAMPLE 62

Example 59 was repeated in the same manner as described except that a coating liquid (125) having the composition shown below was substituted for the coating liquid (122) for the formation of the protecting layer and that the protecting layer was hardened by irradiation with actinic radiation, thereby to obtain an electrophotographic photoconductor No. 62.

Coating Liquid (125):

| | |
|---|---|
| Styrene-methylmethacrylate-2-hydroxymethylmethacrylate copolymer | 10 parts |
| Charge transporting material of the following formula: | 5 parts |

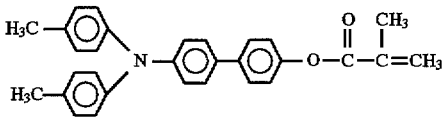

| | |
|---|---|
| Methyl isobutyl ketone | 50 parts |
| Tetrahydrofuran | 100 parts |

EXAMPLE 63

Over an outer surface of an aluminum cylindrical support having a diameter of 120 mm were successively applied and dried a coating liquid (126) for a photoconductive layer and a coating liquid (127) for a protecting layer having the compositions shown below, thereby obtaining an electrophotographic photoconductor No. 63 having the photoconductive layer with a thickness of 20 μm and the charge protecting layer with a thickness of 3 μm.

Coating Liquid (126):

| | |
|---|---|
| Charge generating material of the following formula: | 1 part |

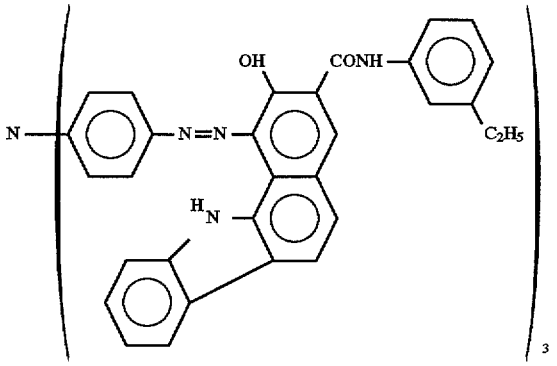

| | |
|---|---|
| Charge transporting material of the following formula: | 10 parts |

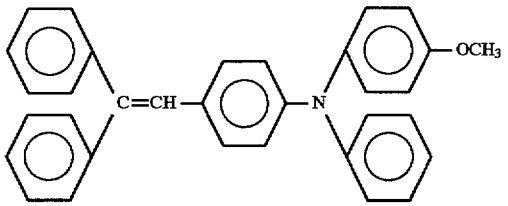

| | |
|---|---|
| Polymeric charge transporting material of the following formula: | 10 parts |

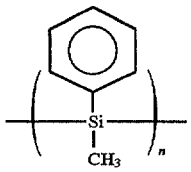

| | |
|---|---|
| Polycarbonate (A3000 manufactured by Idemitsu Petrochemical Inc.) | 10 parts |
| Tetrahydrofuran | 200 parts |

Coating Liquid (127):

| | |
|---|---|
| Polycarbonate (YUPILON S-200 manufactured by Mitsubishi Gas Chemical Inc.) | 10 parts |
| Polymeric charge transporting material of the following formula: | 10 parts |

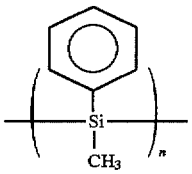

| | |
|---|---|
| Toluene | 200 parts |

EXAMPLE 64

Over an outer surface of an aluminum cylindrical support having a diameter of 120 mm were successively applied and dried a coating liquid (128) for a charge generating layer, a coating liquid (129) for a charge transport layer, a coating liquid (130) for a protecting layer, having the compositions shown below, to form an electrophotographic photoconductor No. 59 having the charge generation layer with a thickness of 0.2 μm, the charge transport layer with a thickness of 20 μm, the protecting layer with a thickness of 3 μm, thereby obtaining an electrophotographic photoconductor No. 64.

Coating Liquid (128):

| | |
|---|---|
| Charge generating material of the following formula: | 5 parts |

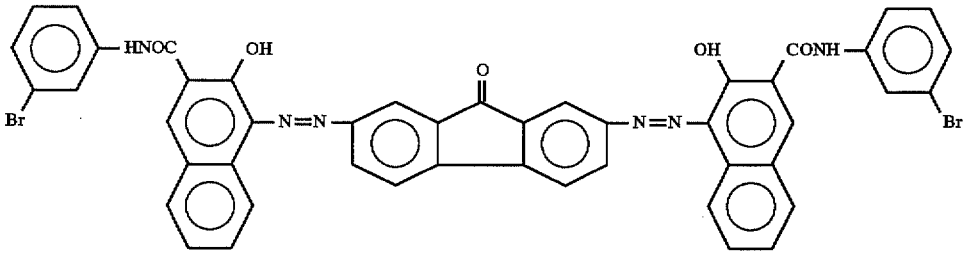

| | |
|---|---|
| Cyclohexanone | 100 parts |
| Tetrahydrofuran | 120 parts |

Coating Liquid (129):

| | |
|---|---|
| Polymeric charge transporting material of the following formula: | 10 parts |

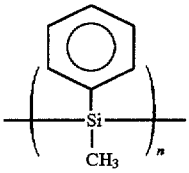

| | |
|---|---|
| Polycarbonate (PANLITE C-1400 manufactured by Teijin Kasei K. K.) | 10 parts |
| Methylene chloride | 150 parts |

Coating Liquid (130):

| | |
|---|---|
| Styrene-methylmethacrylate-2-hydroxymethyl-methacrylate copolymer | 10 parts |
| Polymeric charge transporting material of the following formula: | 3 parts |

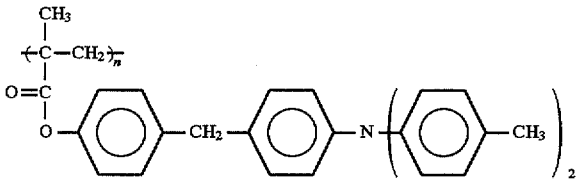

| | |
|---|---|
| Hexamethylenediisocyanate | 0.5 part |

-continued

| | |
|---|---|
| Methyl isobutyl ketone | 80 parts |
| Tetrahydrofuran | 70 parts |

EXAMPLE 65

Example 63 was repeated in the same manner as described except that a coating liquid (131) having the composition shown below was substituted for the coating liquid (127) for the formation of the protecting layer, thereby to obtain an electrophotographic photoconductor No. 65.

Coating Liquid (131):

| | |
|---|---|
| Polycarbonate (YUPILON S-200 manufactured by Mitsubishi Gas Chemical Inc.) | 10 parts |
| Polymeric charge transporting material of the following formula: | 10 parts |

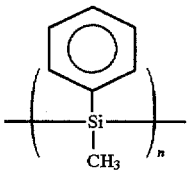

| | |
|---|---|
| Tin oxide | 5 parts |
| Toluene | 200 parts |

EXAMPLE 66

Example 64 was repeated in the same manner as described except that a coating liquid (132) having the composition shown below was substituted for the coating liquid (130) for the formation of the protecting layer, thereby to obtain an electrophotographic photoconductor No. 66.

Coating Liquid (132):

| | |
|---|---|
| Styrene-methylmethacrylate-2-hydroxymethyl-methacrylate copolymer | 10 parts |
| Polymeric charge transporting material of the following formula: | 3 parts |

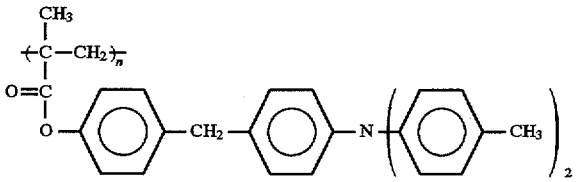

| | |
|---|---|
| Tin oxide | 5 parts |
| Hexamethylenediisocyanate | 0.5 part |
| Methyl isobutyl ketone | 80 parts |
| Tetrahydrofuran | 70 parts |

EXAMPLE 67

Example 64 was repeated in the same manner as described except that a coating liquid (133) having the composition shown below was substituted for the coating liquid (129) for the formation of the charge transport layer, thereby to obtain an electrophotographic photoconductor No. 67.

Coating Liquid (133):

| | |
|---|---|
| Polymeric charge transporting material of the following formula: | 10 parts |

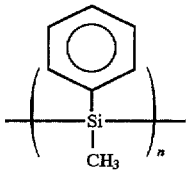

| | |
|---|---|
| Charge transporting material of the following formula: | 5 parts |

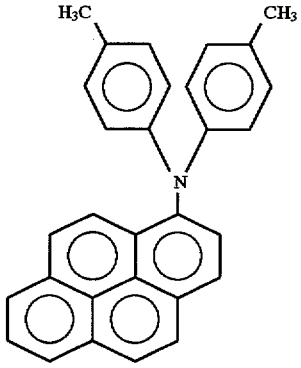

-continued

| | |
|---|---|
| Polycarbonate (PANLITE C-1400 manufactured by Teijin Kasei K. K.) | 10 parts |
| Methylene chloride | 180 parts |

EXAMPLE 68

Example 64 was repeated in the same manner as described except that a coating liquid (134) having the composition shown below was substituted for the coating liquid (128) for the formation of the charge generation layer, thereby to obtain an electrophotographic photoconductor No. 68.

Coating Liquid (134):

| | |
|---|---|
| Charge generating material of the following formula: | 5 parts |

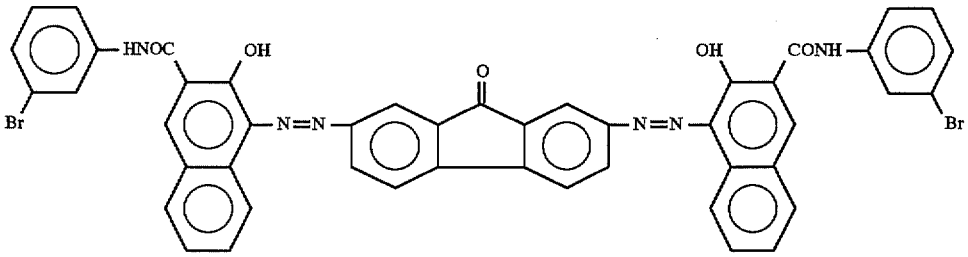

| | |
|---|---|
| Polymeric charge transporting material of the following formula: | 5 parts |

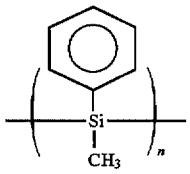

| | |
|---|---|
| Cyclohexanone | 120 parts |
| Tetrahydrofuran | 120 parts |

EXAMPLE 69

Example 64 was repeated in the same manner as described except that an intermediate layer having a thickness of 0.2 μm was formed between the charge generation layer and the charge transport layer by applying a coating liquid (135) having the composition shown below, thereby to obtain an electrophotographic photoconductor No. 69.

Coating Liquid (135):

| | |
|---|---|
| Charge generating material of the following formula: | 3 parts |

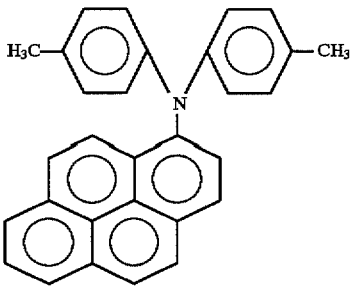

| | |
|---|---|
| Tetrahydrofuran | 80 parts |

EXAMPLE 70

Example 64 was repeated in the same manner as described except that a coating liquid (136) having the composition shown below was substituted for the coating liquid (128) for the formation of the charge generation layer, thereby to obtain an electrophotographic photoconductor No. 70.

Coating Liquid (136):

| | |
|---|---|
| Charge generating material of the following formula: | 5 parts |

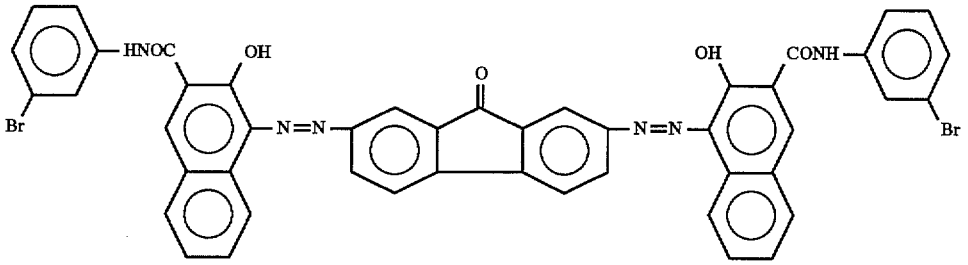

| | |
|---|---|
| Charge transporting material of the following formula: | 5 parts |

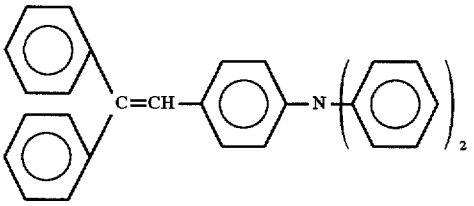

| | |
|---|---|
| Cyclohexanone | 120 parts |
| Tetrahydrofuran | 120 parts |

Comparative Example 23

Example 59 was repeated in the same manner as described except that a coating liquid (137) having the composition shown below was substituted for the coating liquid (122) for the formation of the protecting layer, thereby to obtain an electrophotographic photoconductor No. Comp. 23.

Coating Liquid (137):

| | |
|---|---|
| Polyacrylate (U POLYMER U-100 manufactured by Unichika Inc.) | 10 parts |
| Tetrahydrofuran | 100 parts |

Comparative Example 24

Example 59 was repeated in the same manner as described except that a coating liquid (138) having the composition shown below was substituted for the coating liquid (122) for the formation of the protecting layer, thereby to obtain an electrophotographic photoconductor No. Comp. 24.

Coating Liquid (138):

| | |
|---|---|
| Polyacrylate (U POLYMER U-100 manufactured by Unichika Inc.) | 10 parts |
| Charge transporting material of the following formula: | 5 parts |

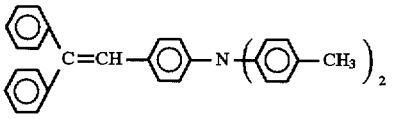

| | |
|---|---|
| Tetrahydrofuran | 150 parts |

Comparative Example 25

Example 62 was repeated in the same manner as described except that a coating liquid (139) having the composition shown below was substituted for the coating liquid (125) for the formation of the protecting layer, thereby to obtain an electrophotographic photoconductor No. Comp. 25.

Coating Liquid (139):

| | |
|---|---|
| Styrene-methylmethacrylate-2-hydroxymethyl-methacrylate copolymer | 10 parts |
| Charge transporting material of the following formula: | 5 parts |

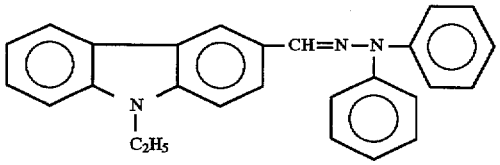

-continued

| | |
|---|---|
| Hexamethylenediisocyanate | 0.5 part |
| Methyl isobutyl ketone | 50 parts |
| Tetrahydrofuran | 100 parts |

Comparative Example 26

Example 63 was repeated in the same manner as described except that the polymeric charge transporting material was removed from the coating liquid (127) for the formation of the protecting layer, thereby to obtain an electrophotographic photoconductor No. Comp. 26.

Comparative Example 27

Example 63 was repeated in the same manner as described except that a coating liquid (140) having the composition shown below was substituted for the coating liquid (127) for the formation of the protecting layer, thereby to obtain an electrophotographic photoconductor No. Comp. 27.

Coating Liquid (140):

Coating Liquid (127):

| | |
|---|---|
| Polycarbonate (YUPILON S-200 manufactured by Mitsubishi Gas Chemical Inc.) | 10 parts |
| Charge transporting material of the following formula: | 10 parts |

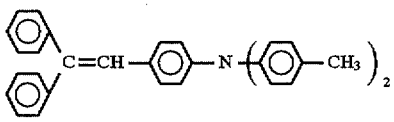

| | |
|---|---|
| | 10 parts |
| Toluene | 200 parts |

Comparative Example 28

Example 64 was repeated in the same manner as described except that the polymeric charge transporting material was removed from the coating liquid (130) for the formation of the protecting layer, thereby to obtain an electrophotographic photoconductor No. Comp. 28.

Comparative Example 29

Example 63 was repeated in the same manner as described except that a coating liquid (141) having the composition shown below was substituted for the coating liquid (130) for the formation of the protecting layer, thereby to obtain an electrophotographic photoconductor No. Comp. 29.

Coating Liquid (141):

| | |
|---|---|
| Styrene-methylmethacrylate-2-hydroxymethyl-methacrylate copolymer | 10 parts |
| Charge transporting material of the following formula: | 3 parts |

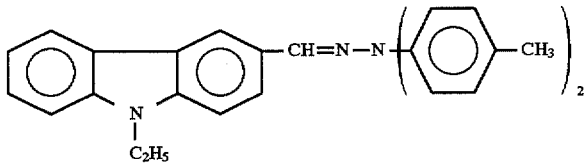

| | |
|---|---|
| | |
| Hexamethylenediisocyanate | 0.5 part |
| Methyl isobutyl ketone | 70 parts |
| Tetrahydrofuran | 80 parts |

The electrophotographic photoconductors Nos. 63–70 and Comp. 26–29 were tested for their photoconductive characteristics using a device disclosed in JP-A-60-100167 in the manner given below.

The photoconductor is subjected to a corona discharge at 6.0 or −6.0 kV for 20 seconds and then dark-decayed. When a surface potential of −800 V is reached, the photoconductor is irradiated with light of a tungsten lamp of 5.1 lux. The, the exposure $E_{400}$ (lux·sec) required to reduce the surface potential to −400 V is measured. Further, the surface potential $V_{30}$ (V) after 30 seconds irradiation with the tungsten lamp is measured. The photoconductor is thereafter subjected simultaneously to the corona discharge and exposure treatments for 1 hour. After the fatigue treatment, the photoconductor is tested for the characteristics thereof in the same manner as above. The results are shown in Table 13.

TABLE 13

| | Initial | | After Fatigue | |
|---|---|---|---|---|
| Photoconductor No. | $E_{400}$ (lux · sec) | $V_{20}$ (−V) | $E_{400}$ (lux · sec) | $V_{20}$ (−V) |
| 63 | 1.23 | 0 | 1.33 | 4 |
| 64 | 1.05 | −2 | 1.06 | −5 |
| 65 | 1.25 | 0 | 1.26 | 1 |
| 66 | 1.04 | 0 | 1.07 | −2 |
| 67 | 0.85 | 0 | 0.84 | −1 |
| 68 | 0.87 | 0 | 0.88 | −2 |
| 69 | 0.85 | 0 | 0.83 | −1 |
| 70 | 0.90 | −1 | 0.92 | −2 |
| Comp. 26 | 1.87 | 10 | 3.66 | 53 |
| Comp. 27 | 1.25 | 0 | 1.29 | 5 |
| Comp. 28 | 1.58 | −12 | 3.88 | −53 |
| Comp. 29 | 1.23 | −3 | 1.55 | −10 |

The photoconductors Nos. 59–62 and Comp. 23–25 were tested for an image reproduction test as follows: The photoconductor is mounted on electrophotographic apparatus RICOPY FT4080 (arranged to be negatively charged) manufactured by Ricoh Company Ltd. The apparatus is allowed to continuously run for obtaining 50,000 copies. The reproduced images obtained at 50,000 copying operation are evaluated. The amount of decrease of the thickness of the protecting transport layer caused by the running test is also measured. The results are summarized in Table 14.

TABLE 14

| Photoconductor No. | $10^5$th copy | Decreased Amount |
|---|---|---|
| 59 | good | 0.5 μm |
| 60 | good | 0.1 μm |
| 61 | good | 0.1 μm |
| 62 | good | 0.1 μm |
| Comp. 23 | * | 0.5 μm |
| Comp. 24 | * | 3.0 μm |
| Comp. 25 | * | 3.0 μm |

*Abnormal image due to abrasion of photoconductor is found (fouling of background or formation of streaks).

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

What is claimed is:

1. An electrophotographic photoconductor comprising an electroconductive support and a photoconductive layer formed on said electroconductive support and including a charge generation layer and a charge transport layer, wherein said charge generation layer comprises a first polymeric charge transporting material having an ionization potential of 6.0 eV or less, wherein said charge transport layer comprises a charge transporting small molecule and a binder.

2. An electrophotographic photoconductor as claimed in claim 1, wherein the ionization potential of said first polymeric charge transporting material is equal to or greater than that of said charge transporting small molecule.

3. An electrophotographic photoconductor as claimed in claim 1, wherein the weight ratio of said charge transporting small molecule to said binder is 8:10 or less.

4. An electrophotographic photoconductor as claimed in claim 1, wherein said charge transport layer additionally comprises a second polymeric charge transporting material.

5. An electrophotographic photoconductor as claimed in claim 4, wherein the ionization potential of said first polymeric charge transporting material is equal to or greater than those of said charge transporting small molecule and said second polymeric charge transporting material.

6. An electrophotographic photoconductor as claimed in claim 1, wherein said charge generation layer consists of a plurality of stacked sub-layers each containing said first polymeric charge transporting material, a binder and a charge generating material and wherein the concentration of said first polymeric charge transporting material in one sub-layer is higher than that of the adjacent sub-layer located remote from said electroconductive support.

7. An electrophotographic photoconductor as claimed in claim 1, wherein said charge generation layer additionally comprises a binder and a charge generating material and wherein the concentration of said first polymeric charge transporting material continuously increases in the direction from said electroconductive support to the surface of said photoconductive layer.

8. An electrophotographic photoconductor as claimed in claim 1, further comprising a protecting layer provided over the surface of said photoconductive layer and containing a third polymeric charge transporting material.

9. An electrophotographic photoconductor as claimed in claim 1, further comprising an intermediate layer provided between said charge generation layer and said charge transport layer.

10. An electrophotographic photoconductor as claimed in claim 9, wherein said intermediate layer contains a charge transporting small molecule.

11. An electrophotographic photoconductor as claimed in claim 1, further comprising an undercoat layer provided between said photoconductive layer and said electroconductive support.

12. An electrophotographic photoconductor as claimed in claim 11, wherein said undercoat layer contains a charge transporting small molecule.

13. An electrophotographic photoconductor as claimed in claim 1, wherein said charge transport layer comprises a charge transporting small molecule and a second polymeric charge transporting material and wherein the concentration of said charge transporting small molecule in said charge transport layer decreases stepwise or continuously in the direction from said electroconductive support toward the surface of said photoconductive layer.

14. An electrophotographic photoconductor comprising an electroconductive support, and a photoconductive layer formed on said electroconductive support and including a charge generation layer and a charge transport layer, wherein said charge generation layer comprises a first polymeric charge transporting material and said charge transport layer comprises a second polymeric charge transporting material and wherein at least one of said charge generation layer and charge transport layer additionally includes a charge transporting small molecule.

15. An electrophotographic photoconductor as claimed in claim 14, further comprising a protecting layer provided over the surface of said photoconductive layer and containing a third polymeric charge transporting material.

16. An electrophotographic photoconductor as claimed in claim 14, further comprising an intermediate layer provided between said charge generation layer and said charge transport layer.

17. An electrophotographic photoconductor as claimed in claim 16, wherein said intermediate layer contains a charge transporting small molecule.

18. An electrophotographic photoconductor as claimed in claim 14, further comprising an undercoat layer provided between said photoconductive layer and said electroconductive support.

19. An electrophotographic photoconductor as claimed in claim 18, wherein said undercoat layer contains a charge transporting small molecule.

20. An electrophotographic photoconductor as claimed in claim 14, wherein said charge transport layer comprises said charge transporting small molecule and said second polymeric charge transporting material and wherein the concentration of said charge transporting small molecule in said charge transport layer decreases stepwise or continuously in the direction from said electroconductive support toward the surface of said photoconductive layer.

21. An electrophotographic photoconductor comprising an electroconductive support, and a photoconductive layer formed on said electroconductive support and including a charge generation layer, a charge transport layer and an intermediate layer provided therebetween and containing a charge transporting small molecule, wherein said charge generation layer comprises a first polymeric charge transporting material and said charge transport layer comprises a second polymeric charge transporting material.

22. An electrophotographic photoconductor as claimed in claim 21, further comprising a protecting layer provided over the surface of said photoconductive layer and containing a third polymeric charge transporting material.

23. An electrophotographic photoconductor as claimed in claim 21, further comprising an undercoat layer provided between said photoconductive layer and said electroconductive support.

24. An electrophotographic photoconductor as claimed in claim 23, wherein said undercoat layer contains a charge transporting small molecule.

25. An electrophotographic photoconductor comprising an electroconductive support, and a photoconductive layer formed on said electroconductive support and including a charge generation layer and a charge transport layer, wherein said charge generation layer comprises a polymeric charge transporting material and said charge transport layer comprises a charge transporting small molecule and a binder.

26. An electrophotographic photoconductor as claimed in claim 25, wherein the weight ratio of said charge transporting small molecule to said binder is 8:10 or less.

27. An electrophotographic photoconductor as claimed in claim 25, further comprising a protecting layer provided over the surface of said photoconductive layer and containing a polymeric charge transporting material.

28. An electrophotographic photoconductor as claimed in claim 25, further comprising an intermediate layer provided between said charge generation layer and said charge transport layer.

29. An electrophotographic photoconductor as claimed in claim 28, wherein said intermediate layer contains a charge transporting small molecule.

30. An electrophotographic photoconductor as claimed in claim 25, further comprising an undercoat layer provided between said photoconductive layer and said electroconductive support.

31. An electrophotographic photoconductor as claimed in claim 30, wherein said undercoat layer contains a charge transporting small molecule.

32. An electrophotographic photoconductor comprising an electroconductive support, and a photoconductive layer formed on said electroconductive support and including a charge generation layer and a charge transport layer, wherein said charge transport layer comprises a polymeric charge transporting material and wherein an intermediate layer containing a charge transporting small molecule is interposed between said charge generation layer and said charge transport layer.

33. An electrophotographic photoconductor as claimed in claim 32, further comprising a protecting layer provided over the surface of said photoconductive layer and containing a polymeric charge transporting material.

34. An electrophotographic photoconductor comprising an electroconductive support, a photoconductive layer formed on said electroconductive support, and an undercoat layer provided between said photoconductive layer and said electroconductive support and containing a charge transporting small molecule and a polymeric charge transporting material, wherein said photoconductive layer comprises a charge generation layer and a charge transport layer.

35. An electrophotographic photoconductor as claimed in claim 34, wherein said undercoat layer additionally contains powder of an metal oxide.

36. An electrophotographic photoconductor as claimed in claim 34, further comprising a protecting layer provided over the surface of said photoconductive layer and containing a polymeric charge transporting material.

37. An electrophotographic photoconductor as claimed in claim 34, wherein at least one of said charge generation layer and charge transport layer contains a polymeric charge transporting material.

38. An electrophotographic photoconductor comprising an electroconductive support, a photoconductive layer formed on said electroconductive support, and a protecting layer provided over the surface of said photoconductive layer and including a polymeric charge transporting material, wherein said protecting layer comprises a filler.

39. An electrophotographic photoconductor as claimed in claim 38, wherein said protecting layer additionally contains a binder.

40. An electrophotographic photoconductor as claimed in claim 39, wherein said binder has been cured.

41. An electrophotographic photoconductor as claimed in claim 38, wherein said photoconductive layer includes a charge generation layer and a charge transport layer.

42. An electrophotographic photoconductor as claimed in claim 41, wherein at least one of said charge generation layer and charge transport layer contains a polymeric charge transporting material.

43. An electrophotographic photoconductor comprising an electroconductive support, and a photoconductive layer formed on said electroconductive support and including a charge generation layer and a charge transport layer, wherein said charge transport layer includes a polymeric charge transporting material and a charge transporting small molecule and wherein the concentration of said charge transporting small molecule in said charge transport layer decreases in the direction from said electroconductive support toward the surface of said photoconductive layer.

44. An electrophotographic photoconductor as claimed in claim 43, further comprising a protecting layer provided over the surface of said photoconductive layer and containing a polymeric charge transporting material.

45. An electrophotographic photoconductor as claimed in claim 43, further comprising an intermediate layer provided between said charge generation layer and said charge transport layer.

46. An electrophotographic photoconductor as claimed in claim 45, wherein said intermediate layer contains a charge transporting small molecule.

47. An electrophotographic photoconductor as claimed in claim 43, further comprising an undercoat layer provided between said photoconductive layer and said electroconductive support.

48. An electrophotographic photoconductor as claimed in claim 47, wherein said undercoat layer contains a charge transporting small molecule.

49. An electrophotographic photoconductor as claimed in claim 43, wherein the concentration of said charge transporting small molecule at a portion adjacent to the surface of said charge transport layer is 10% by weight or less while the concentration of said charge transporting small molecule at that portion of said charge transport layer nearest to said electroconductive support is 20% by weight or more.

* * * * *

UNITED STATES PATENT AND TRADEMARK OFFICE

CERTIFICATE OF CORRECTION

PATENT NO. : 5,677,094

DATED : OCTOBER 14, 1997

INVENTOR(S) : MINORU UMEDA ET AL

It is certified that error appears in the above-identified patent and that said Letters Patent is hereby corrected as shown below:

Column 5, line 6, "7" should read --6--.

Column 7, line 5, "[1,2b]" should read --[1,2-b]--.

Column 22, line 49, "obtain" should read --shown--.

Column 31, line 67, "(33)" should read --(32)--.

Column 50, line 13, "1 parts" should read --1 part--.

Column 51, line 28, "Misubishi" should read --Mitsubishi--.

Column 60, line 64, "5.98" should read --5.78--.

Column 78, line 37, "Methyl" should read --Methylene--.

Column 88, line 57, "PAN LITE" should read --PANLITE--.

UNITED STATES PATENT AND TRADEMARK OFFICE

CERTIFICATE OF CORRECTION

PATENT NO. : 5,677,094
DATED : OCTOBER 14, 1997
INVENTOR(S) : MINORU UMEDA ET AL

It is certified that error appears in the above-identified patent and that said Letters Patent is hereby corrected as shown below:

Column 90, line 26, "Methyl" should read --Methylene--.

Column 94, line 64, "Misubishi" should read --Mitsubishi--.

Signed and Sealed this

Fourteenth Day of July, 1998

Bruce Lehman

*Attest:*

BRUCE LEHMAN

*Attesting Officer*

*Commissioner of Patents and Trademarks*